US009431760B2

(12) United States Patent
Itou

(10) Patent No.: US 9,431,760 B2
(45) Date of Patent: Aug. 30, 2016

(54) ELECTRICAL CONNECTOR CAPABLE OF CONNECTING A PLURALITY OF ELECTRIC WIRES TO A CONNECTION OBJECT

(71) Applicant: Japan Aviation Electronics Industry, Ltd., Tokyo (JP)

(72) Inventor: Yasukazu Itou, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/667,212

(22) Filed: Mar. 24, 2015

(65) Prior Publication Data

US 2015/0280361 A1 Oct. 1, 2015

(30) Foreign Application Priority Data

Mar. 31, 2014 (JP) ..... 2014-071467

(51) Int. Cl.

| | |
|---|---|
| ***H01R 13/625*** | (2006.01) |
| ***H01R 13/627*** | (2006.01) |
| ***H01R 24/28*** | (2011.01) |
| ***H01R 13/73*** | (2006.01) |
| ***H01R 31/06*** | (2006.01) |
| *H01R 101/00* | (2006.01) |

(52) U.S. Cl.

CPC ..... *H01R 13/6271* (2013.01); *H01R 13/73* (2013.01); *H01R 24/28* (2013.01); *H01R 31/06* (2013.01); *H01R 2101/00* (2013.01)

(58) Field of Classification Search

CPC ... H01R 13/6271; H01R 24/28; H01R 31/02
USPC ..... 439/345, 733.1, 907, 754, 500, 505
See application file for complete search history.

(56) References Cited

U.S. PATENT DOCUMENTS

| | | | | |
|---|---|---|---|---|
| 5,221,219 | A * | 6/1993 | Thomson | H01R 11/281 29/857 |
| 5,645,448 | A * | 7/1997 | Hill | H01H 85/205 439/522 |
| 6,302,709 | B1 * | 10/2001 | Ross | H01R 4/34 439/78 |
| 6,461,172 | B2 * | 10/2002 | Ross | H01R 4/34 439/78 |
| 6,512,443 | B1 * | 1/2003 | Matsumura | H01H 85/044 337/161 |
| 7,176,780 | B2 * | 2/2007 | Iwata | H01H 85/044 337/161 |
| 7,663,466 | B1 * | 2/2010 | Jetton | H01H 85/044 337/186 |
| 7,990,738 | B2 * | 8/2011 | Urrea | H01H 85/12 361/833 |
| 8,303,351 | B2 * | 11/2012 | Taguchi | H01H 85/22 439/620.26 |

(Continued)

FOREIGN PATENT DOCUMENTS

| | | | |
|---|---|---|---|
| JP | 06084511 A | * | 3/1994 |
| JP | 5352723 B1 | | 11/2013 |

*Primary Examiner* — Tulsidas C Patel
*Assistant Examiner* — Peter G Leigh
(74) *Attorney, Agent, or Firm* — Maier & Maier, PLLC

(57) ABSTRACT

A pin connector includes a pin contact and a pin housing. The pin contact includes: an upper contact portion having a flat plate shape and being in electrical contact with an upper socket connector; a lower contact portion having a flat plate shape and being in electrical contact with a lower socket connector; and an electrode contact portion having a flat plate shape and being in electrical contact with a battery. A thickness direction of the upper contact portion and a thickness direction of the lower contact portion are substantially perpendicular to a thickness direction of the electrode contact portion. A direction in which the upper socket connector is mated with the pin connector is different from a direction in which the lower socket connector is mated with the pin connector.

12 Claims, 22 Drawing Sheets

(56) References Cited

U.S. PATENT DOCUMENTS 8,638,188 B2 * 1/2014 Iwata ..... G01R 1/0408 337/186

8,821,190 B2 * 9/2014 Matsumura ..... H01H 85/044 337/186

2012/0299691 A1 * 11/2012 Takase ..... H01R 4/185 337/142

* cited by examiner

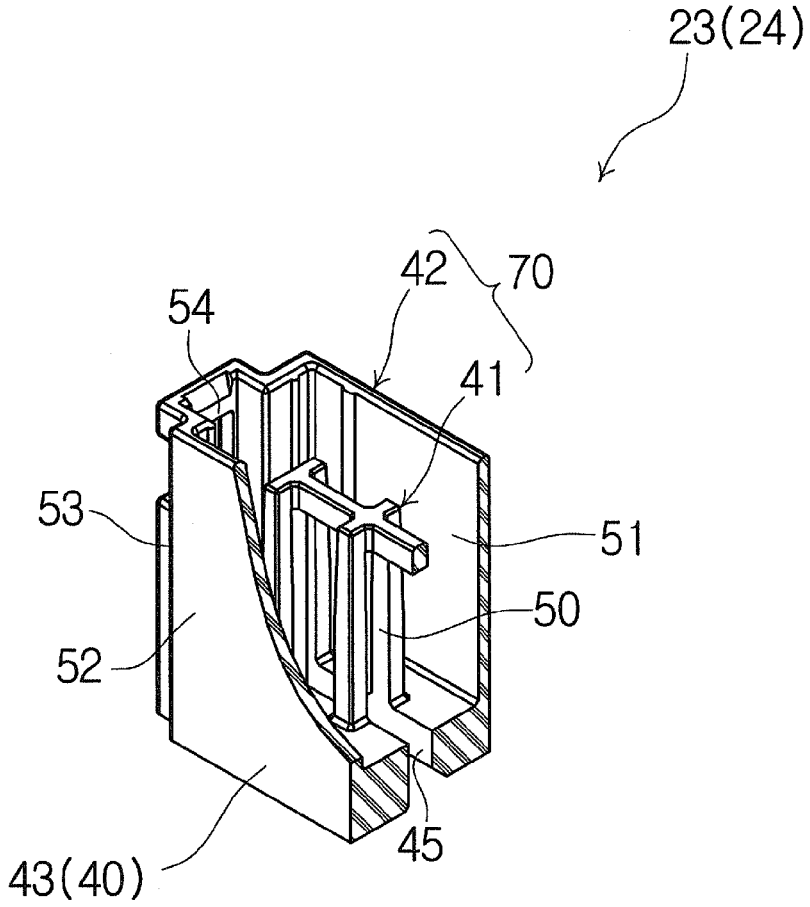
Fig. 15
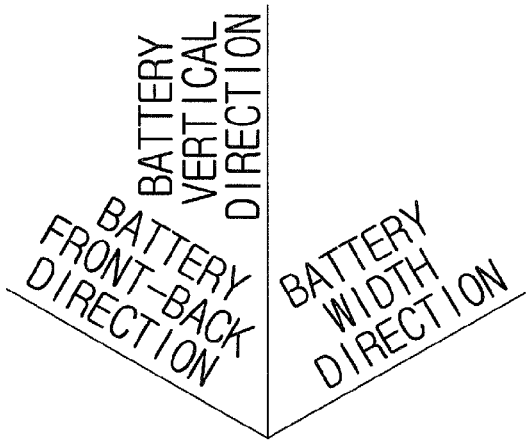

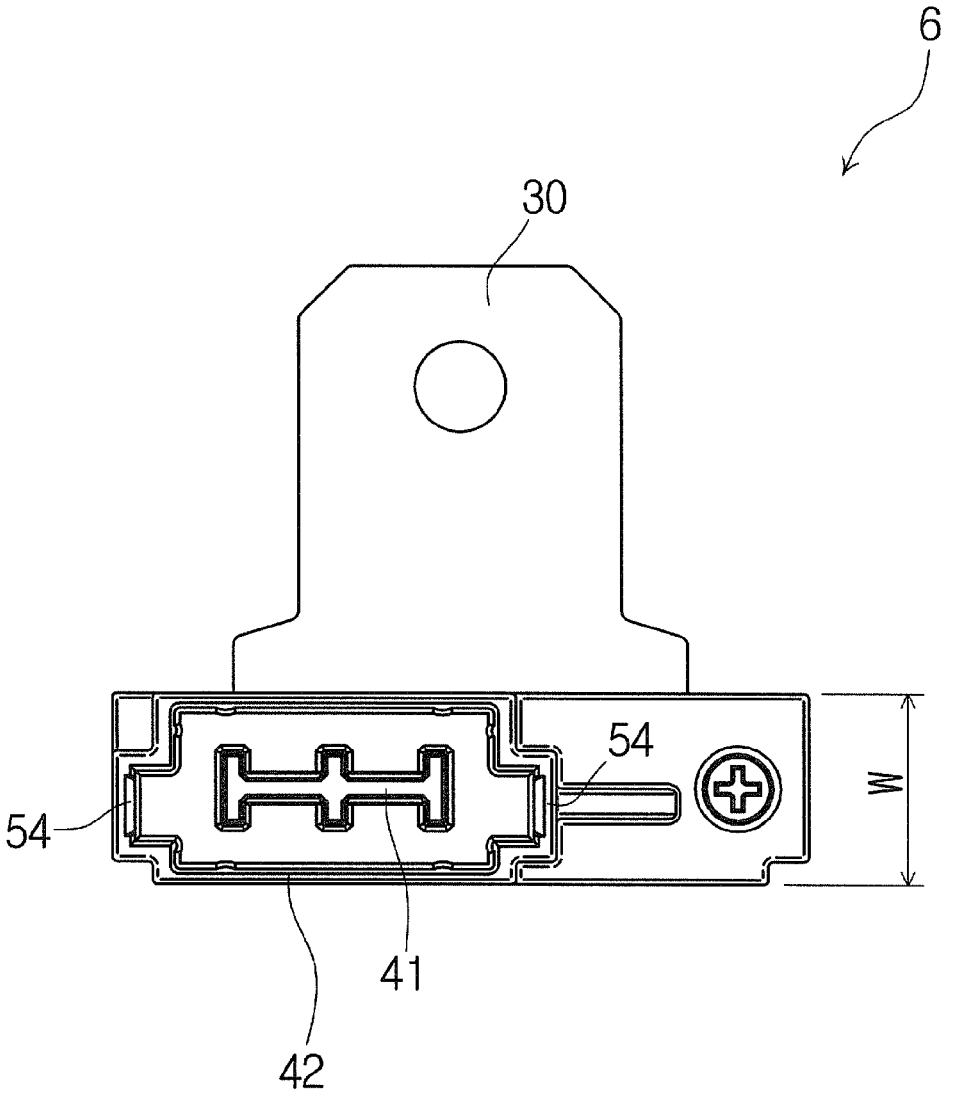
Fig. 16
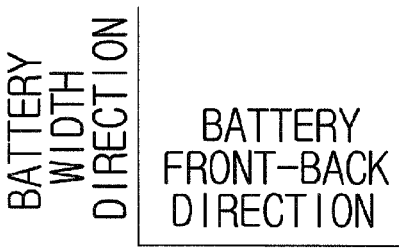

ELECTRICAL CONNECTOR CAPABLE OF CONNECTING A PLURALITY OF ELECTRIC WIRES TO A CONNECTION OBJECT

INCORPORATION BY REFERENCE

This application is based upon and claims the benefit of priority from Japanese patent application No. 2014-071467, filed on Mar. 31, 2014, the disclosure of which is incorporated herein in its entirety by reference.

BACKGROUND OF THE INVENTION

1. Field of the Invention

The present invention relates to an electric connector, a connection object unit, and a connection object unit assembly.

2. Description of Related Art

Japanese Patent No. 5352723 discloses a plug connector 102 and a receptacle connector 103 which are used to connect a connection cable 101 to a battery 100 as shown in FIG. 22 of this application. The plug connector 102 is attached to an end of the connection cable 101. The receptacle connector 103 is attached to a battery post 106 with a nut 107. The battery post 106 has an external thread shape and projects from an upper surface 105 of a battery body 104 of the battery 100. The receptacle connector 103 includes a receptacle contact 109 and a receptacle housing 110. The receptacle contact 109 has a bolt hole 108 formed therein for bolt-fastening. In the above structure, when the plug connector 102 is mated with the receptacle connector 103, the connection cable 101 is connected to the battery 100.

Incidentally, there is a demand for simultaneously connecting a plurality of connection cables 101 to the battery post 106 of the battery 100. There is also a demand for further downsizing of the receptacle connector 103.

It is an object of the present invention to provide a technique for downsizing an electric connector capable of connecting a plurality of electric wires to a connection object.

SUMMARY OF THE INVENTION

A first exemplary aspect of the present invention is an electric connector that is attached to a connection object, is mated with a first connector attached to a first electric wire to thereby electrically connect the first electric wire to the connection object, and is mated with a second connector attached to a second electric wire to thereby electrically connect the second electric wire to the connection object, the electric connector including: a contact; and a housing that is attached to the contact, the housing including: a first retaining portion that prevents the first connector mated with the electric connector from being disengaged from the electric connector; and a second retaining portion that prevents the second connector mated with the electric connector from being disengaged from the electric connector. The contact includes: a first contact portion having a flat plate shape and capable of being in electrical contact with the first connector; a second contact portion having a flat plate shape and capable of being in electrical contact with the second connector; and a third contact portion having a flat plate shape and capable of being in electrical contact with the connection object. A thickness direction of the first contact portion and a thickness direction of the second contact portion are substantially perpendicular to a thickness direction of the third contact portion. A direction in which the first connector is mated with the electric connector is different from a direction in which the second connector is mated with the electric connector.

A second exemplary aspect of the present invention is a connection object unit including a connection object and a connector assembly including: a first connector attached to a first electric wire; a second connector attached to a second electric wire; and an electric connector that is attached to the connection object, is mated with the first connector to thereby electrically connect the first electric wire to the connection object, and is mated with the second connector to thereby electrically connect the second electric wire to the connection object. The electric connector includes a contact and a housing that is attached to the contact, the housing including: a first retaining portion that prevents the first connector mated with the electric connector from being disengaged from the electric connector; and a second retaining portion that prevents the second connector mated with the electric connector from being disengaged from the electric connector. The contact includes: a first contact portion having a flat plate shape and capable of being in electrical contact with the first connector; a second contact portion having a flat plate shape and capable of being in electrical contact with the second connector; and a third contact portion having a flat plate shape and capable of being in electrical contact with the connection object. A thickness direction of the first contact portion and a thickness direction of the second contact portion are substantially perpendicular to a thickness direction of the third contact portion. A direction in which the first connector is mated with the electric connector is different from a direction in which the second connector is mated with the electric connector.

According to exemplary aspects of the present invention, it is possible to downsize an electric connector capable of connecting a plurality of electric wires to a connection object.

The above and other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIG. 15 is a partially cutaway perspective view of the upper housing divided body (first exemplary embodiment);

FIG. 16 is a plan view of the pin connector (first exemplary embodiment);

DESCRIPTION OF THE EXEMPLARY EMBODIMENTS

First Exemplary Embodiment

Figure 1:
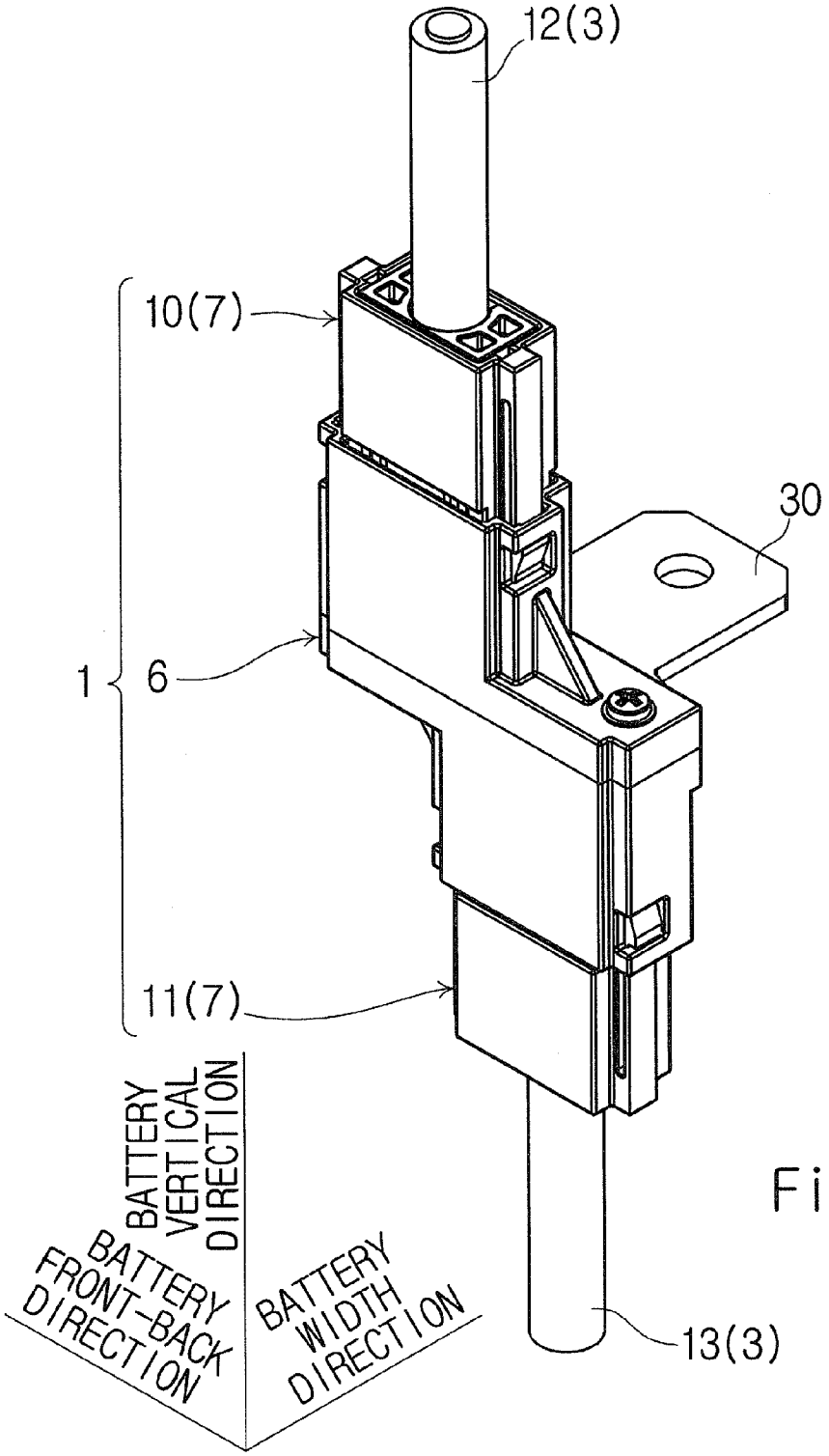
FIG. 1 is a perspective view of a connector assembly (first exemplary embodiment)
Figure 2:
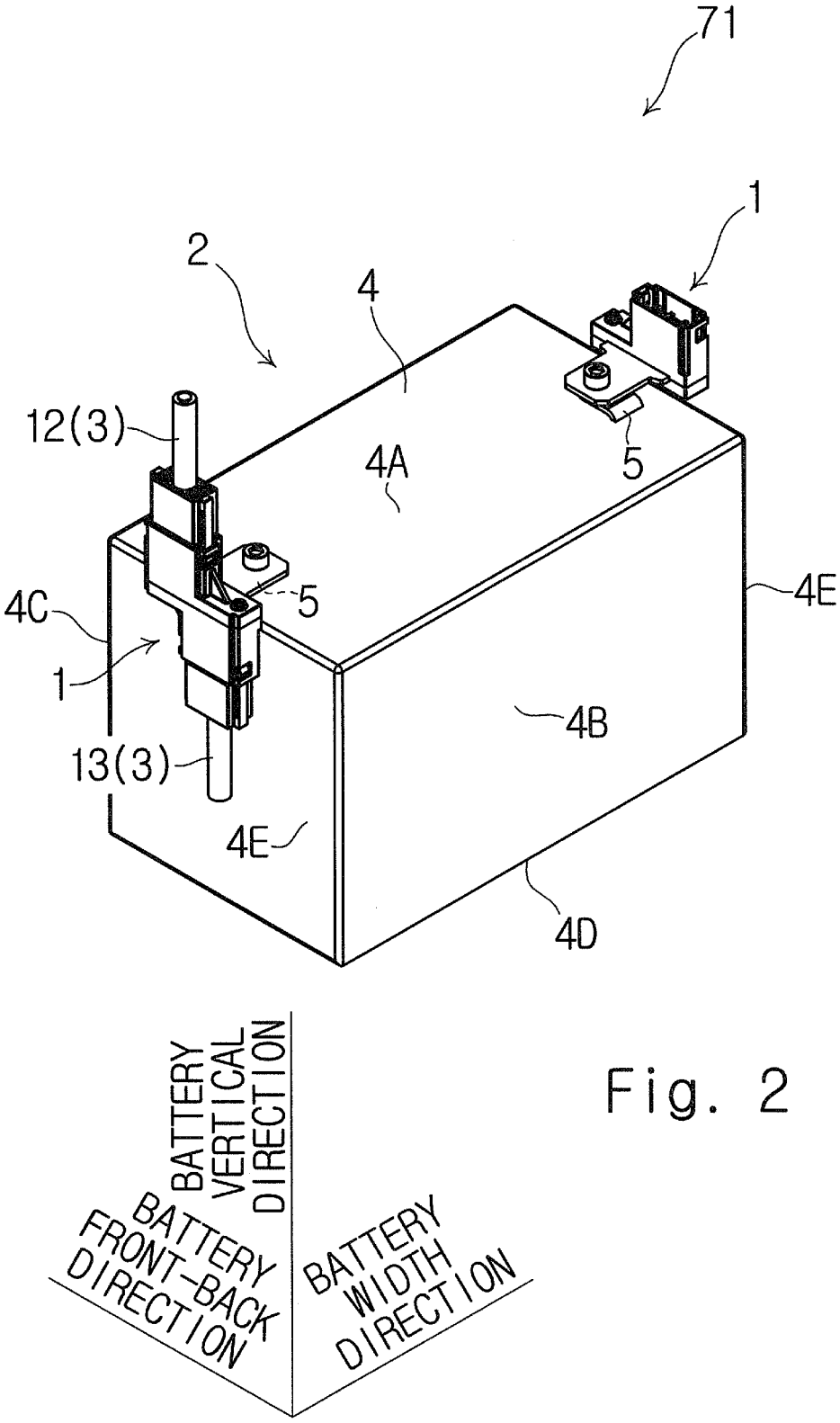
FIG. 2 is a perspective view of a battery to which the connector assembly is attached (first exemplary embodiment)
Figure 3:
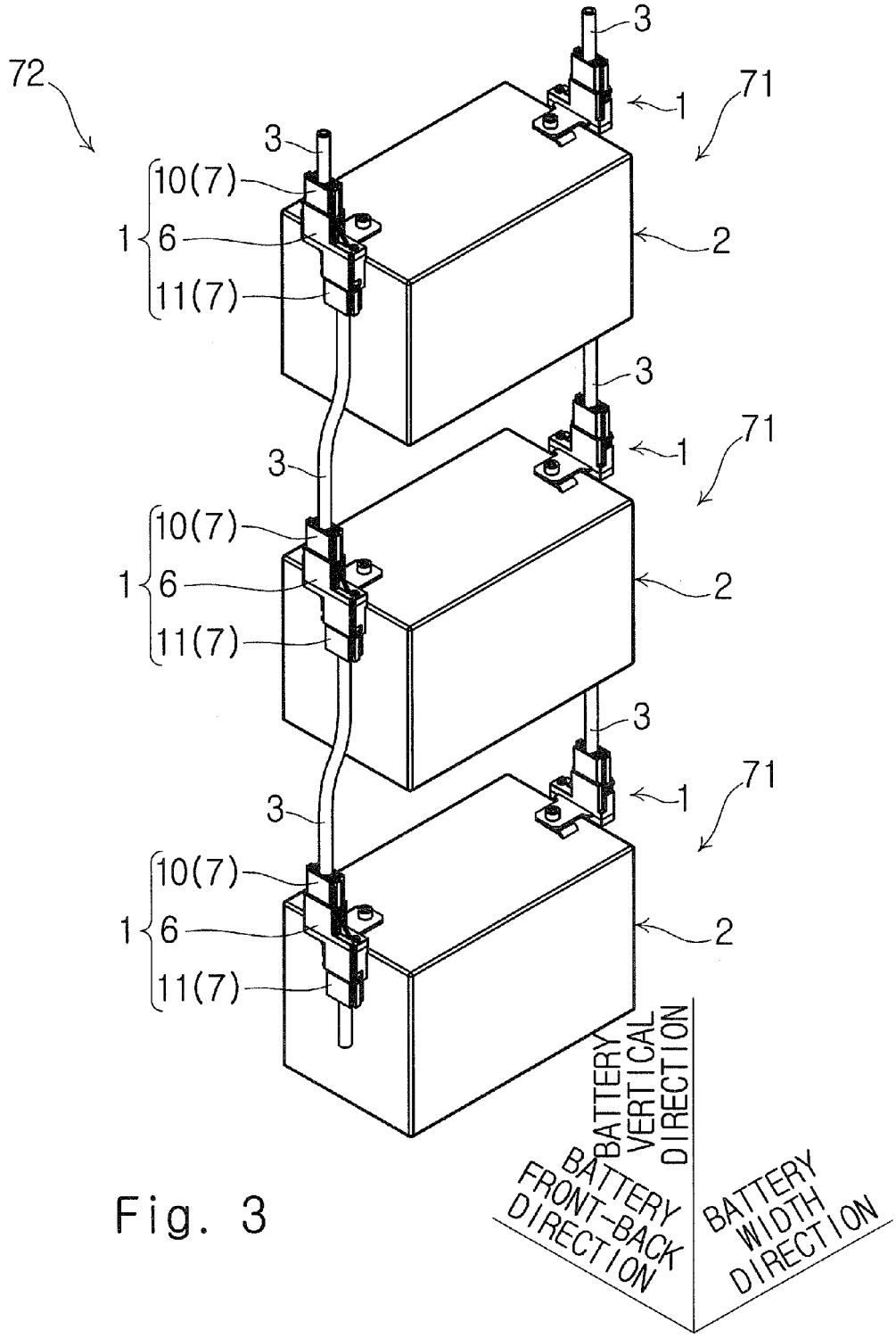
FIG. 3 is a perspective view showing a state in which a plurality of batteries are connected to each other (first exemplary embodiment)

FIGS. 1 to 3 each show a connector assembly 1. In a first exemplary embodiment, the connector assembly 1 is used to electrically connect a plurality of batteries 2 (connection object), which are arranged in a predetermined direction, with a plurality of cables 3 as shown in FIGS. 2 and 3.

As shown in FIG. 2, each battery 2 includes a rectangular-parallelepiped-shaped battery body 4 and a pair of electrodes 5. The battery body 4 includes a rectangular upper surface 4A (electrode arrangement surface), a front surface 4B, a back surface 4C, a lower surface 4D, and a pair of side surfaces 4E. The pair of electrodes 5 is formed on the upper surface 4A of the battery body 4. The pair of electrodes 5 is disposed on both ends in the longitudinal direction of the upper surface 4A of the battery body 4.

The terms "battery vertical direction", "battery width direction", and "battery front-back direction" will now be defined. The term "battery vertical direction" refers to a direction orthogonal to the upper surface 4A. The battery vertical direction includes an upward direction and a downward direction. The upward direction is a direction from the lower surface 4D to the upper surface 4A, and the downward direction is a direction from the upper surface 4A to the lower surface 4D. The term "battery width direction" refers to the longitudinal direction of the upper surface 4A. The battery width direction includes a battery width center direction and a battery width anti-center direction. In the battery width direction, the battery width center direction is a direction approaching the center in the longitudinal direction of the upper surface 4A, and the battery width anti-center direction is a direction away from the center in the longitudinal direction of the upper surface 4A. The term "battery front-back direction" refers to a direction orthogonal to each of the battery vertical direction and the battery width direction. The battery front-back direction includes a battery backward direction and a battery forward direction. The battery backward direction is a direction from the front surface 4B to the back surface 4C, and the battery forward direction is a direction from the back surface 4C to the front surface 4B.

In the first exemplary embodiment, as shown in FIG. 3, the plurality of batteries 2 are arranged at a predetermined pitch in the vertical direction by using a battery storage rack or the like.

As shown in FIG. 1, the connector assembly 1 includes a pin connector 6 (electric connector) and a pair of socket connectors 7. FIG. 1 shows a state in which the pair of socket connectors 7 is mated with the pin connector 6. For convenience of explanation, the socket connector 7 located on an upper side of the pin connector 6 is referred to as an upper socket connector 10 (first connector) and the socket connector 7 located on a lower side of the pin connector 6 is referred to as a lower socket connector 11 (second connector). The cable 3 located on an upper side of the connector assembly 1 is referred to as an upper cable 12 (first electric wire) and the cable 3 located on a lower side of the connector assembly 1 is referred to as a lower cable 13 (second electric wire).

As shown in FIGS. 1 and 2, the pin connector 6 is a connector attached to one of the pair of electrodes 5. The upper socket connector 10 is a connector attached to an end of the upper cable 12. The lower socket connector 11 is a connector attached to an end of the lower cable 13. When the upper socket connector 10 and the lower socket connector 11 are mated with the pin connector 6, the upper cable 12 and the lower cable 13 are electrically connected to one of the electrodes 5 of the battery 2 shown in FIG. 2.

(Pin Connector 6)

Next, the pin connector 6 will be described with reference to FIGS. 4 to 16.

Figure 4:
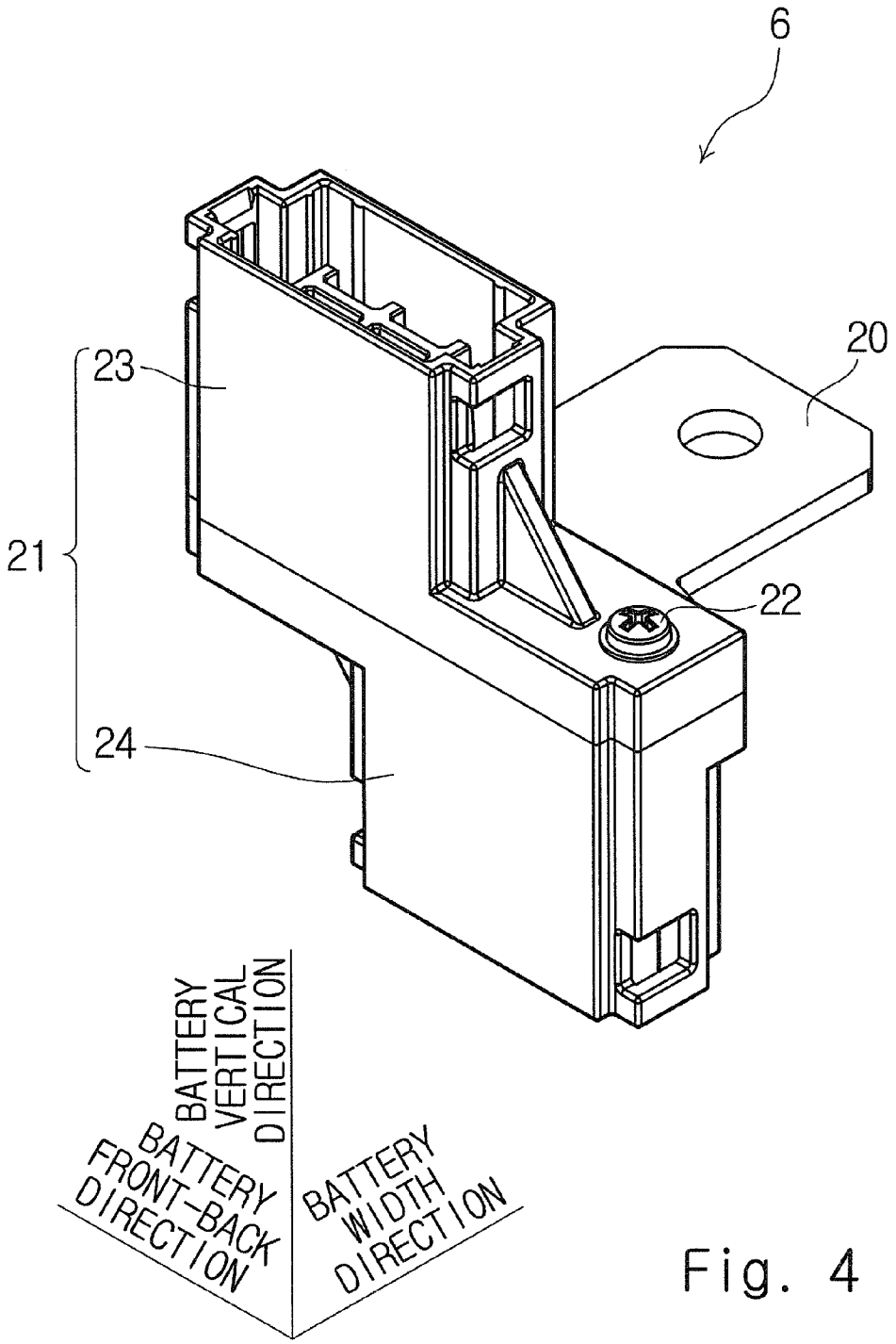
FIG. 4 is a perspective view of a pin connector (first exemplary embodiment)
Figure 5:
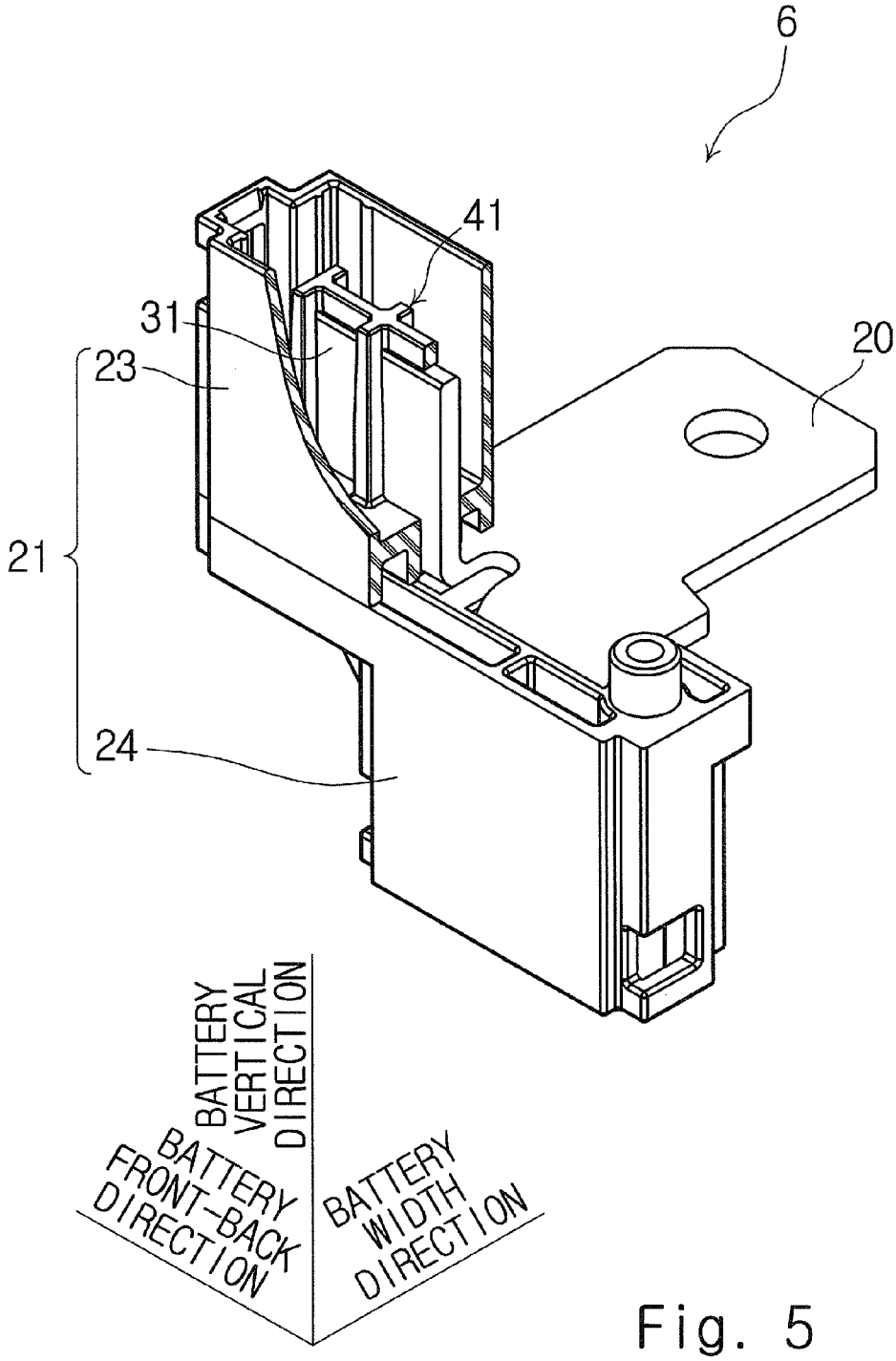
FIG. 5 is a partially cutaway perspective view of the pin connector (first exemplary embodiment)
Figure 6:
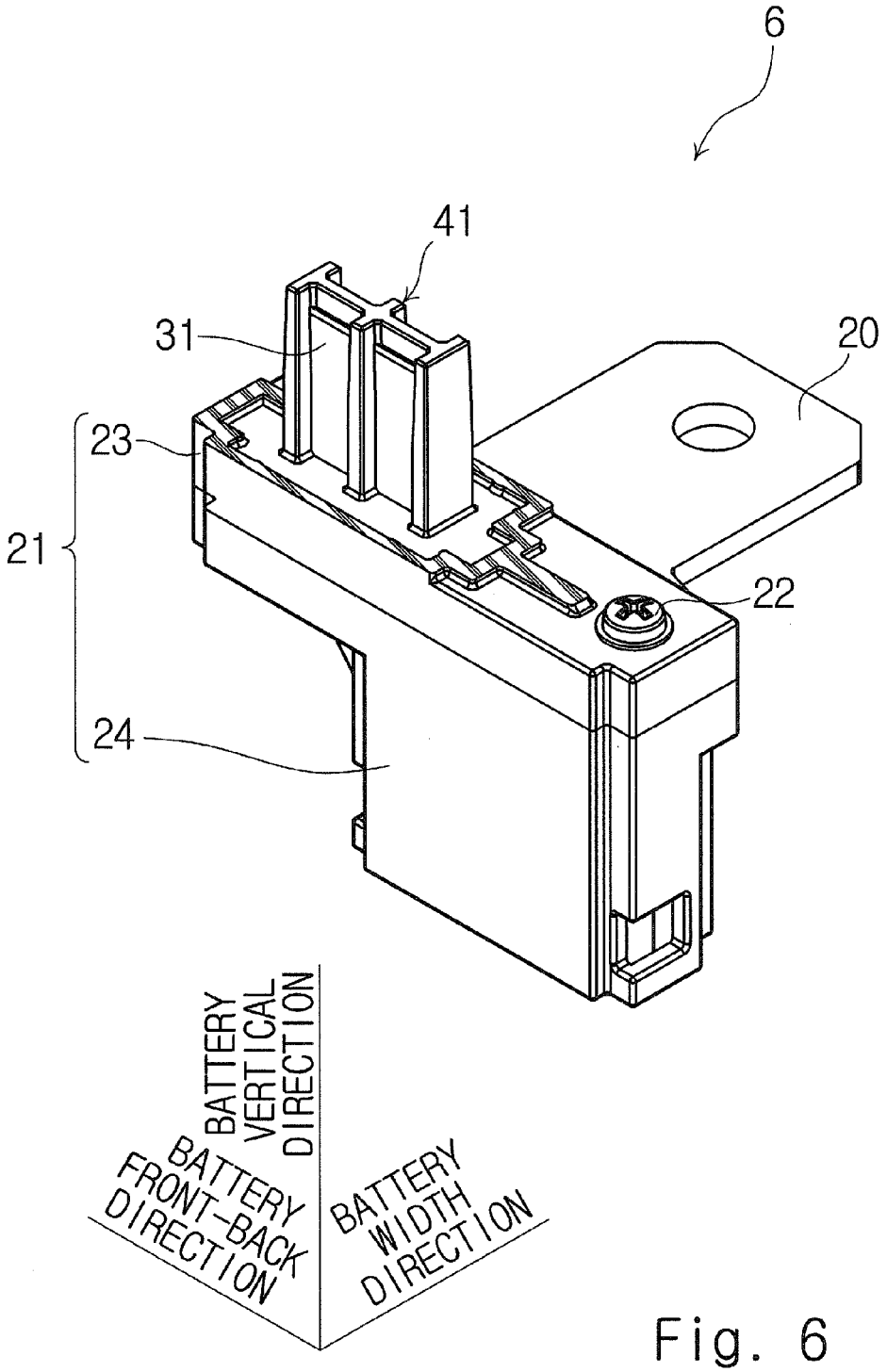
FIG. 6 is a partially cutaway perspective view of the pin connector (first exemplary embodiment)
Figure 7:
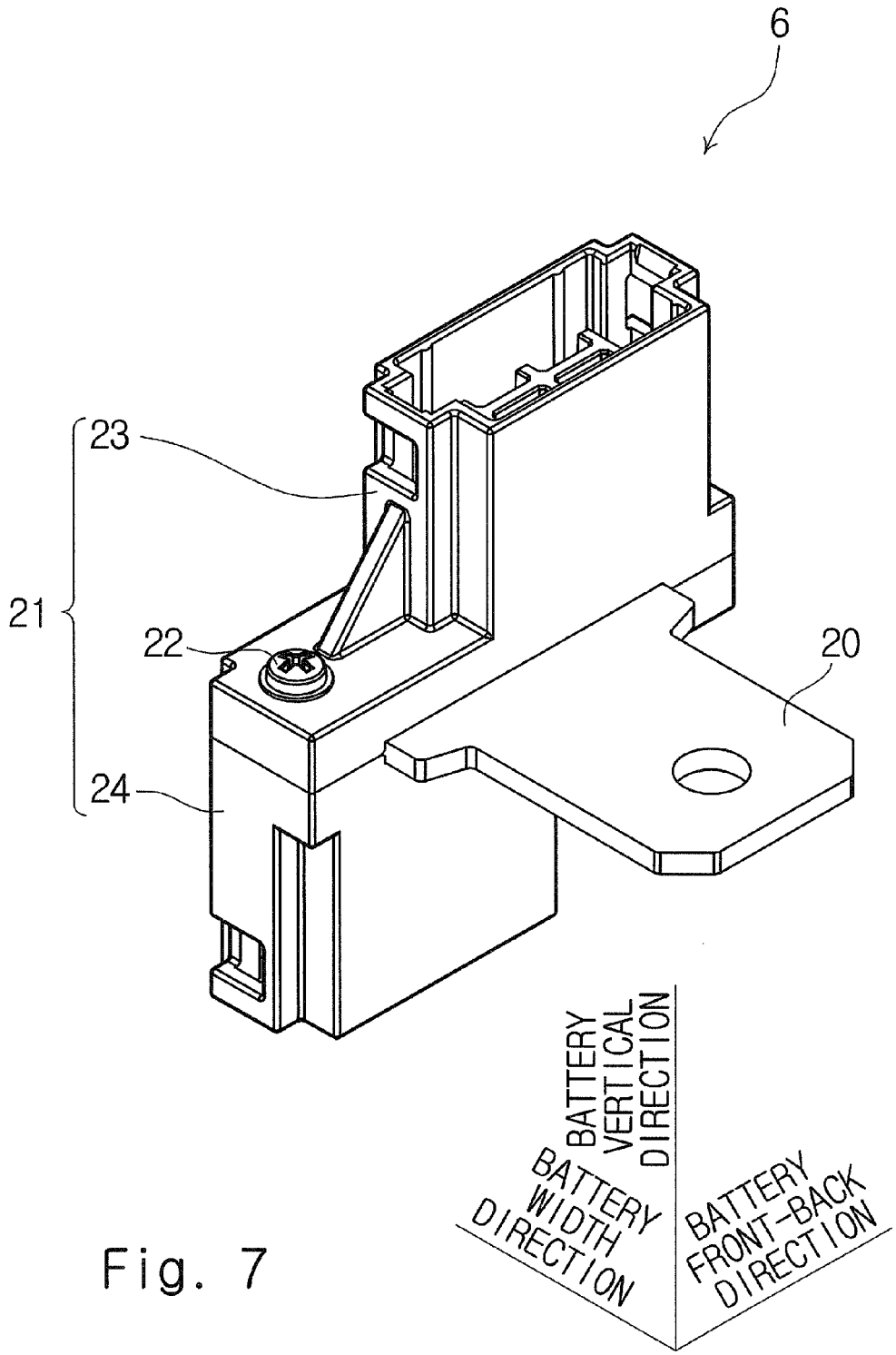
FIG. 7 is a perspective view of the pin connector when viewed from another angle (first exemplary embodiment)
Figure 8:
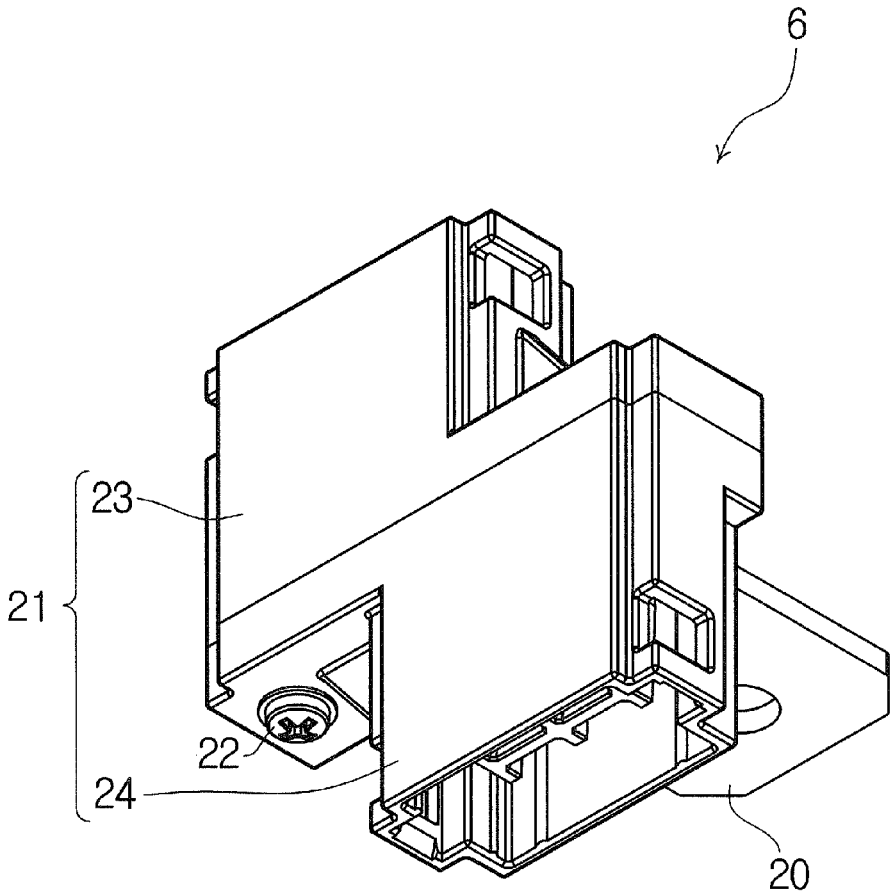
FIG. 8 is a perspective view of the pin connector when viewed from still another angle (first exemplary embodiment)
Figure 8:
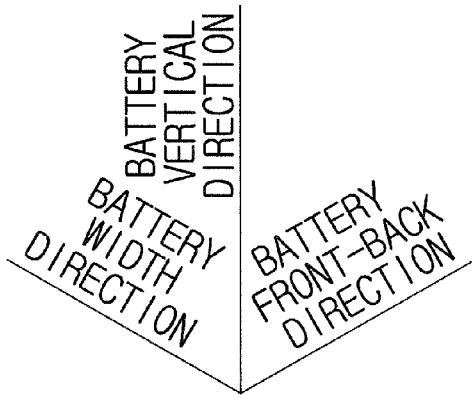
Figure 9:
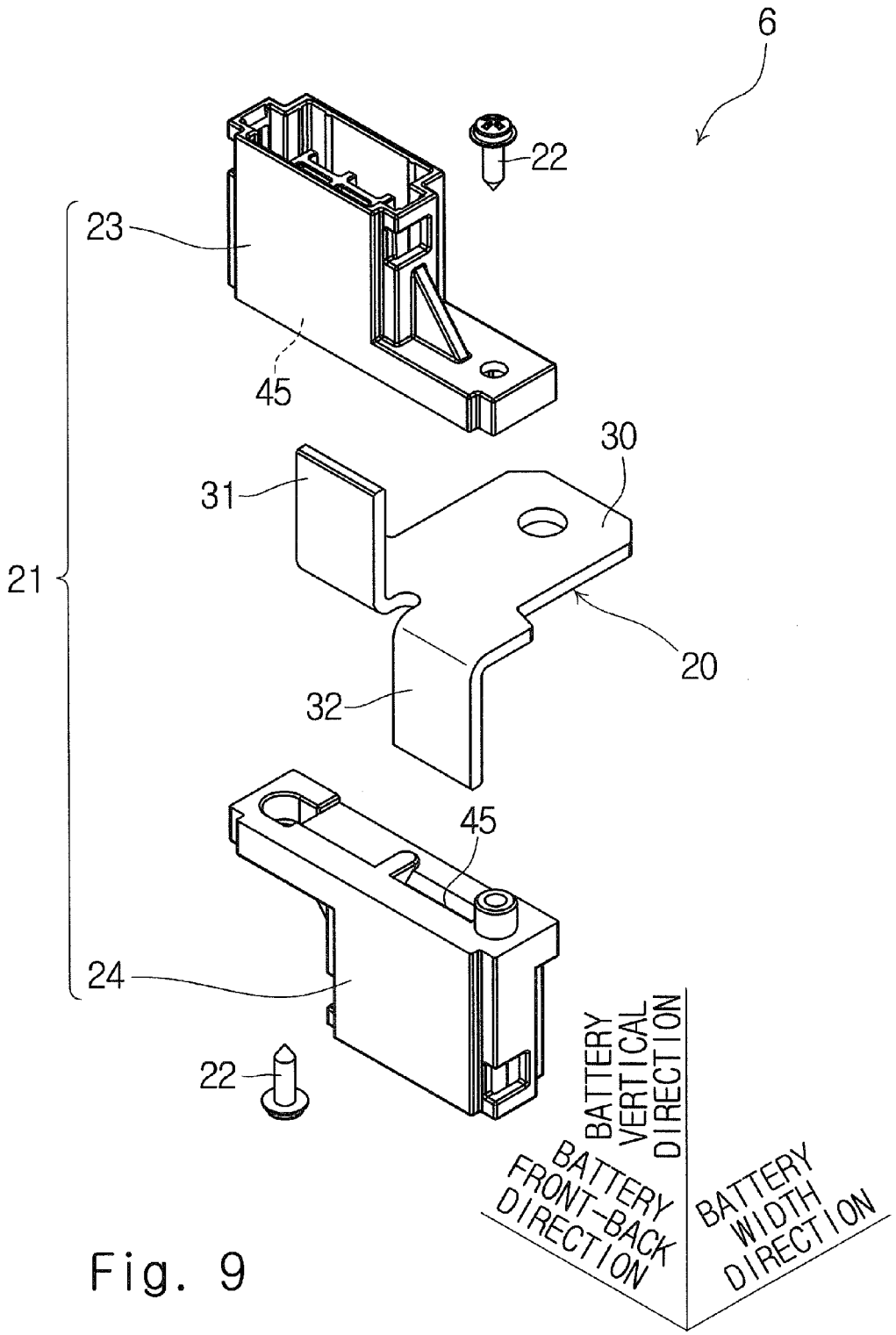
FIG. 9 is an exploded perspective view of the pin connector (first exemplary embodiment)
Figure 10:
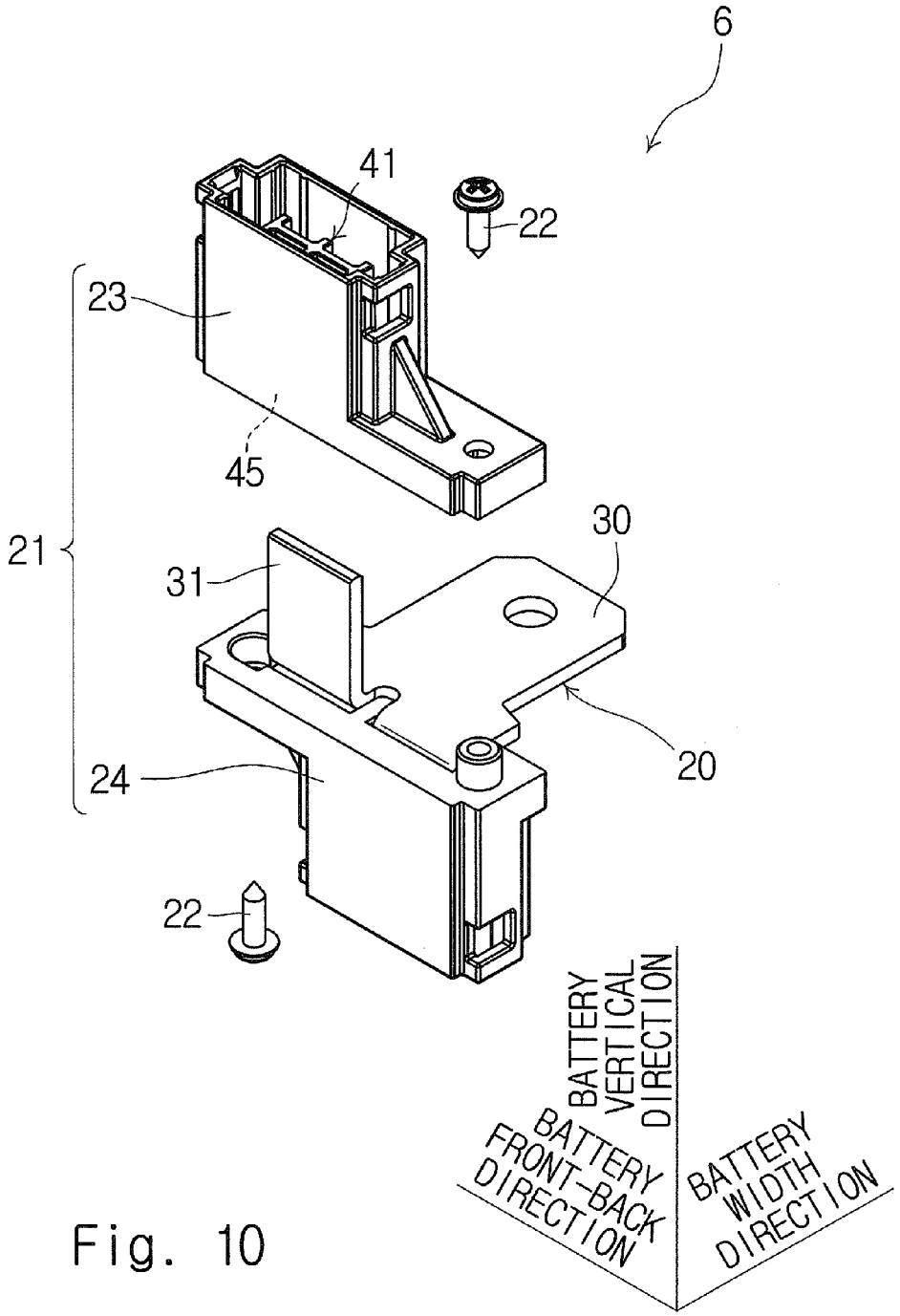
FIG. 10 is an exploded perspective view of the pin connector (first exemplary embodiment)

FIGS. 4, 7, and 8 each show a perspective view of the pin connector 6 viewed from various directions. FIGS. 5 and 6 each show a partially cutaway perspective view of the pin connector 6. FIGS. 9 and 10 each show an exploded view of the pin connector 6. As shown in FIGS. 4 to 10, the pin connector 6 includes a pin contact 20 (contact), a pin housing 21 (housing), and two screws 22. The pin housing 21 includes an upper housing divided body 23 (first housing divided body) and a lower housing divided body 24 (second housing divided body) that is located under the upper housing divided body 23. In the state where the upper housing divided body 23 and the lower housing divided body 24 are made to cover the pin contact 20, the upper housing divided body 23 and the lower housing divided body 24 are coupled together with the two screws 22, thereby allowing the pin housing 21 to be attached to the pin contact 20.

(Pin Contact 20)

Figure 11:
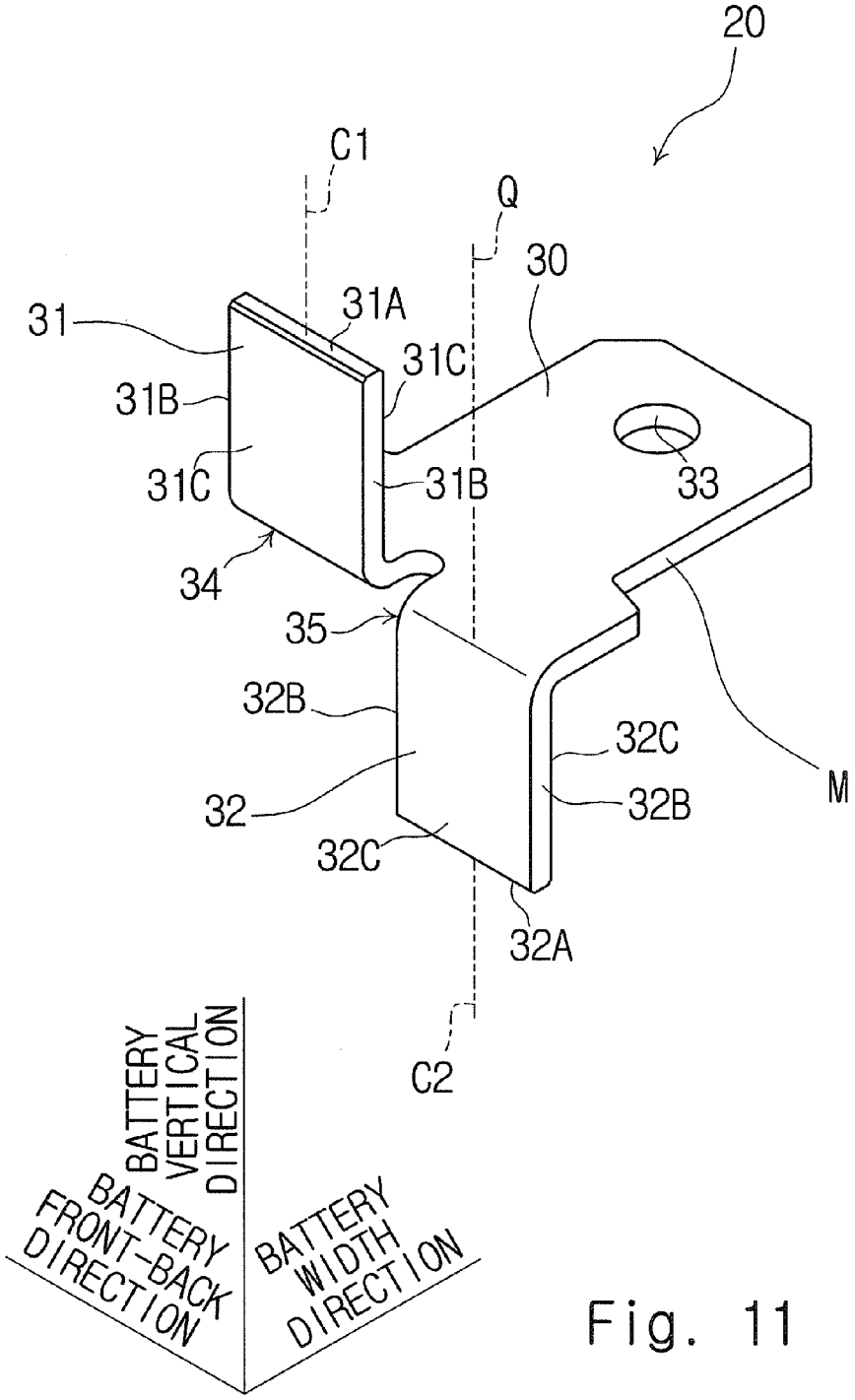
FIG. 11 is a perspective view of a pin contact (first exemplary embodiment)
Figure 12:
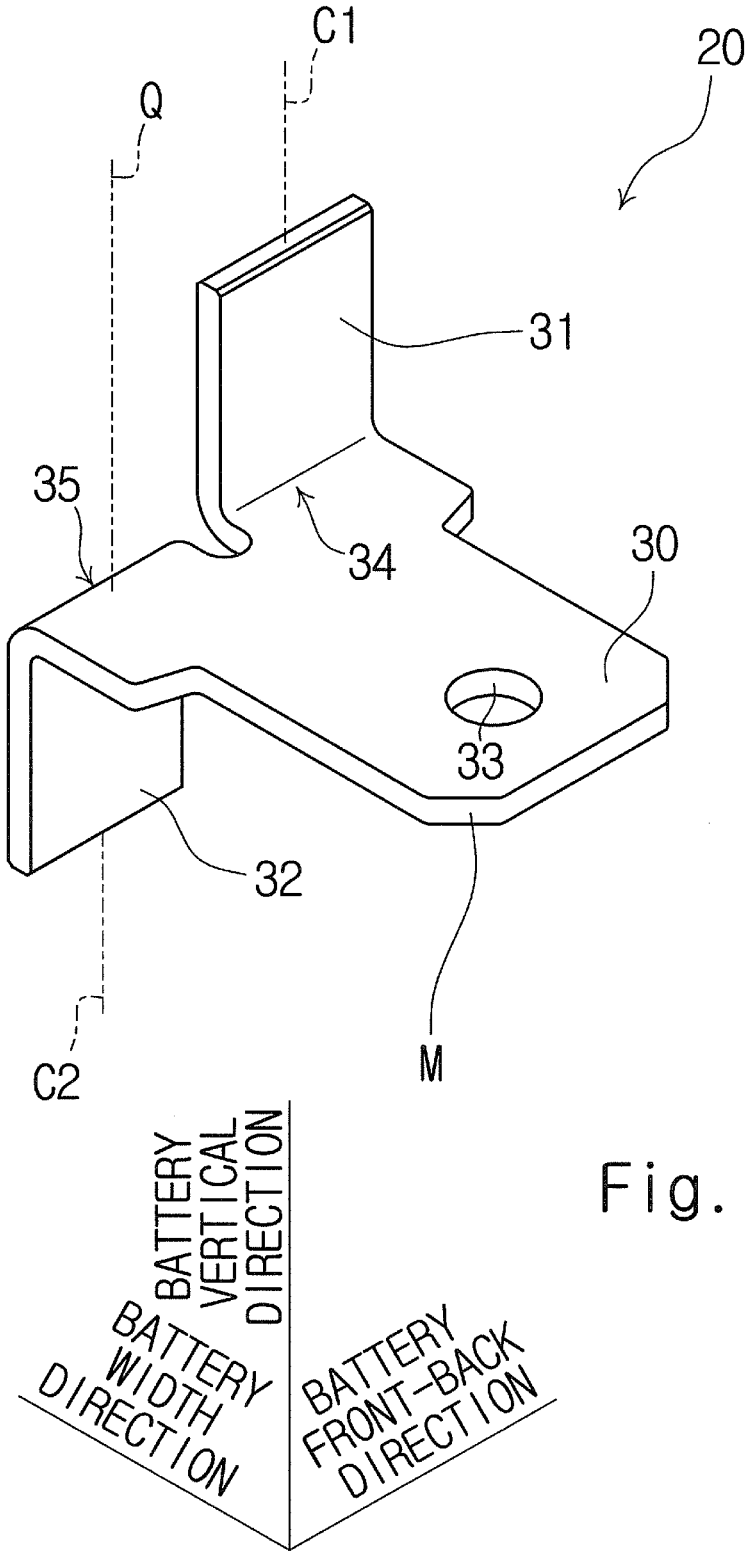
FIG. 12 is a perspective view of the pin contact when viewed from another angle (first exemplary embodiment)

FIGS. 11 and 12 each show a perspective view of the pin contact 20 viewed from different directions. As shown in FIGS. 11 and 12, the pin contact 20 is formed by bending a metallic plate M having a thickness of about 3 mm. Specifically, the pin contact 20 includes an electrode contact portion 30 (third contact portion), an upper contact portion 31 (first contact portion), and a lower contact portion 32 (second contact portion).

The electrode contact portion 30 has a flat plate shape, and the thickness direction of the electrode contact portion 30 is substantially parallel to the battery vertical direction. The electrode contact portion 30 is formed in a rectangular shape elongated in the battery width direction. The electrode contact portion 30 has a mounting hole 33 formed therein for attaching the pin contact 20 to the corresponding electrode 5 of the battery 2.

The upper contact portion 31 has a flat plate shape, and the thickness direction of the upper contact portion 31 is substantially parallel to the battery width direction. In other words, the thickness direction of the upper contact portion 31 is substantially perpendicular to the thickness direction of the electrode contact portion 30. The upper contact portion 31 is formed so as to project upward from an end of the electrode contact portion 30 on the battery width anti-center direction side. The upper contact portion 31 includes a distal end face 31A, a pair of side end faces 31B, and a pair of contact surfaces 31C. The distal end face 31A is substantially orthogonal to the battery vertical direction. The pair of side end faces 31B is substantially orthogonal to the battery front-back direction. The pair of contact surfaces 31C is substantially orthogonal to the battery width direction. An upper connecting portion 34 (a first connecting portion, a first fold, and a first bent portion) is formed between the upper contact portion 31 and the electrode contact portion 30. The upper contact portion 31 and the electrode contact portion 30 are connected to each other at the upper connecting portion 34. The upper connecting portion 34 is a portion where the upper contact portion 31 having a flat plate shape and the electrode contact portion 30 having a flat plate shape are connected to each other, and is thus inevitably formed to have a linear appearance. The upper connecting portion 34 formed to have a linear appearance extends in the battery front-back direction. The upper contact portion 31 has a central axis C1. The central axis C1 is the central axis of the upper contact portion 31 in the direction parallel to the projecting direction of the upper contact portion 31.

The lower contact portion 32 has a flat plate shape, and the thickness direction of the lower contact portion 32 is substantially parallel to the battery width direction. In other words, the thickness direction of the lower contact portion 32 is substantially perpendicular to the thickness direction of the electrode contact portion 30. The lower contact portion 32 is formed so as to project downward from an end of the electrode contact portion 30 on the battery width anti-center direction side. The lower contact portion 32 includes a distal end face 32A, a pair of side end faces 32B, and a pair of contact surfaces 32C. The distal end face 32A is substantially orthogonal to the battery vertical direction. The pair of side end faces 32B is substantially orthogonal to the battery front-back direction. The pair of contact surfaces 32C is substantially orthogonal to the battery width direction. A lower connecting portion 35 (a second connecting portion, a second fold, and a second bent portion) is formed between the lower contact portion 32 and the electrode contact portion 30. The lower contact portion 32 and the electrode contact portion 30 are connected to each other at the lower connecting portion 35. The lower connecting portion 35 is a portion where the lower contact portion 32 having a flat plate shape and the electrode contact portion 30 having a flat plate shape are connected to each other, and is thus inevitably formed to have a linear appearance. The lower connecting portion 35 formed to have a linear appearance extends in the battery front-back direction. The lower contact portion 32 has a central axis C2. The central axis C2 is the central axis of the lower contact portion 32 in the direction parallel to the projecting direction of the lower contact portion 32.

In the first exemplary embodiment, the upper contact portion 31 and the lower contact portion 32 are disposed at different locations in the battery front-back direction. In other words, the central axis C1 of the upper contact portion 31 does not coincide with a virtual extension Q of the central axis C2 of the lower contact portion 32. Specifically, the upper contact portion 31 is located on the battery backward direction side relative to the lower contact portion 32.

The upper contact portion 31 and the lower contact portion 32 are disposed at the same location in the battery width direction.

The upper contact portion 31 and the lower contact portion 32 are disposed at different locations in the battery vertical direction. Specifically, the upper contact portion 31 is located on an upper side relative to the lower contact portion 32. In other words, the direction in which the upper contact portion 31 projects from the electrode contact portion 30 is opposite to the direction in which the lower contact portion 32 projects from the electrode contact portion 30.

The thickness direction of the upper contact portion 31 and the thickness direction of the lower contact portion 32 are substantially parallel to each other.

(Upper Housing Divided Body 23)

Figure 13:
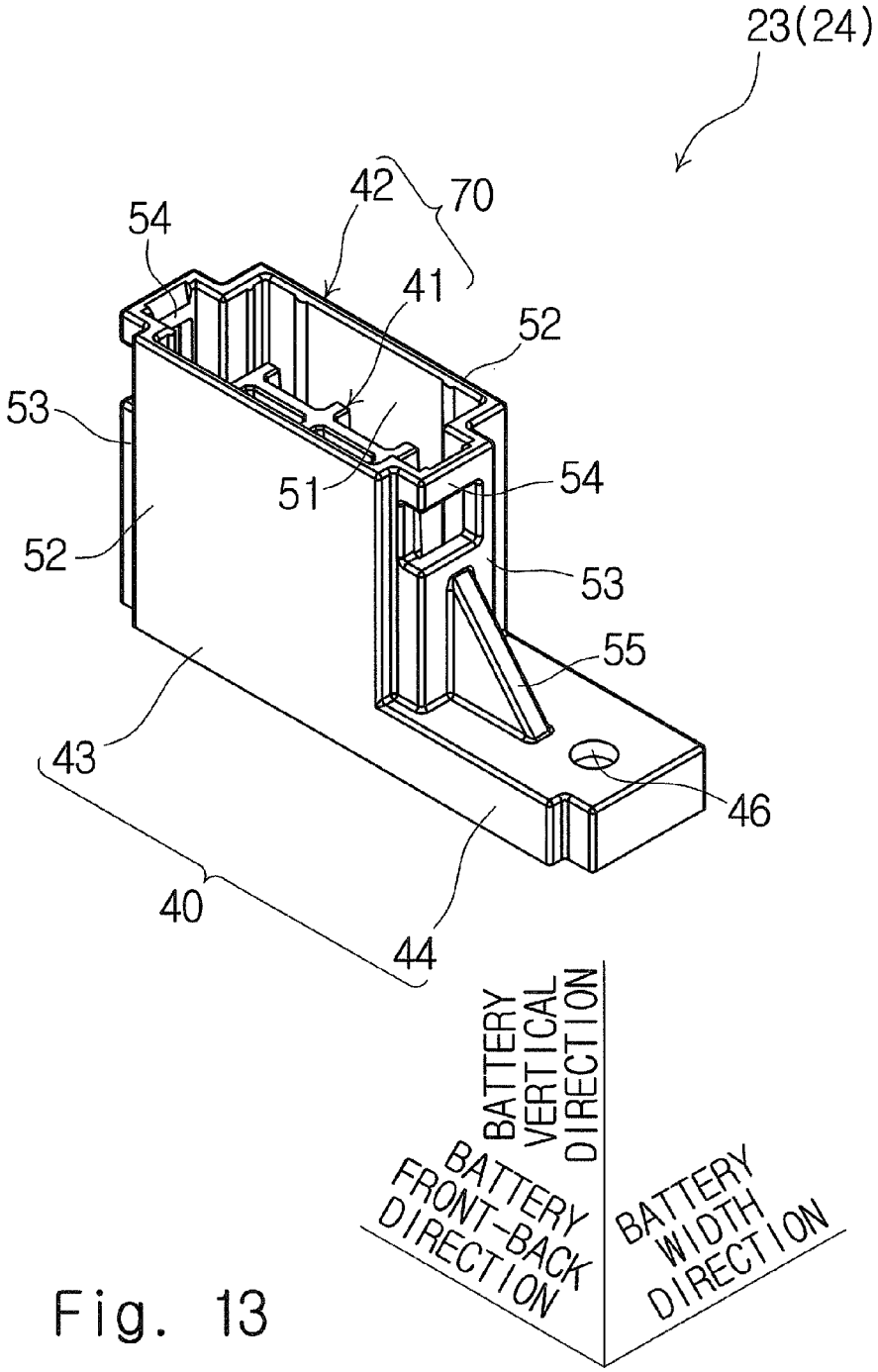
FIG. 13 is a perspective view of an upper housing divided body (first exemplary embodiment)
Figure 14:
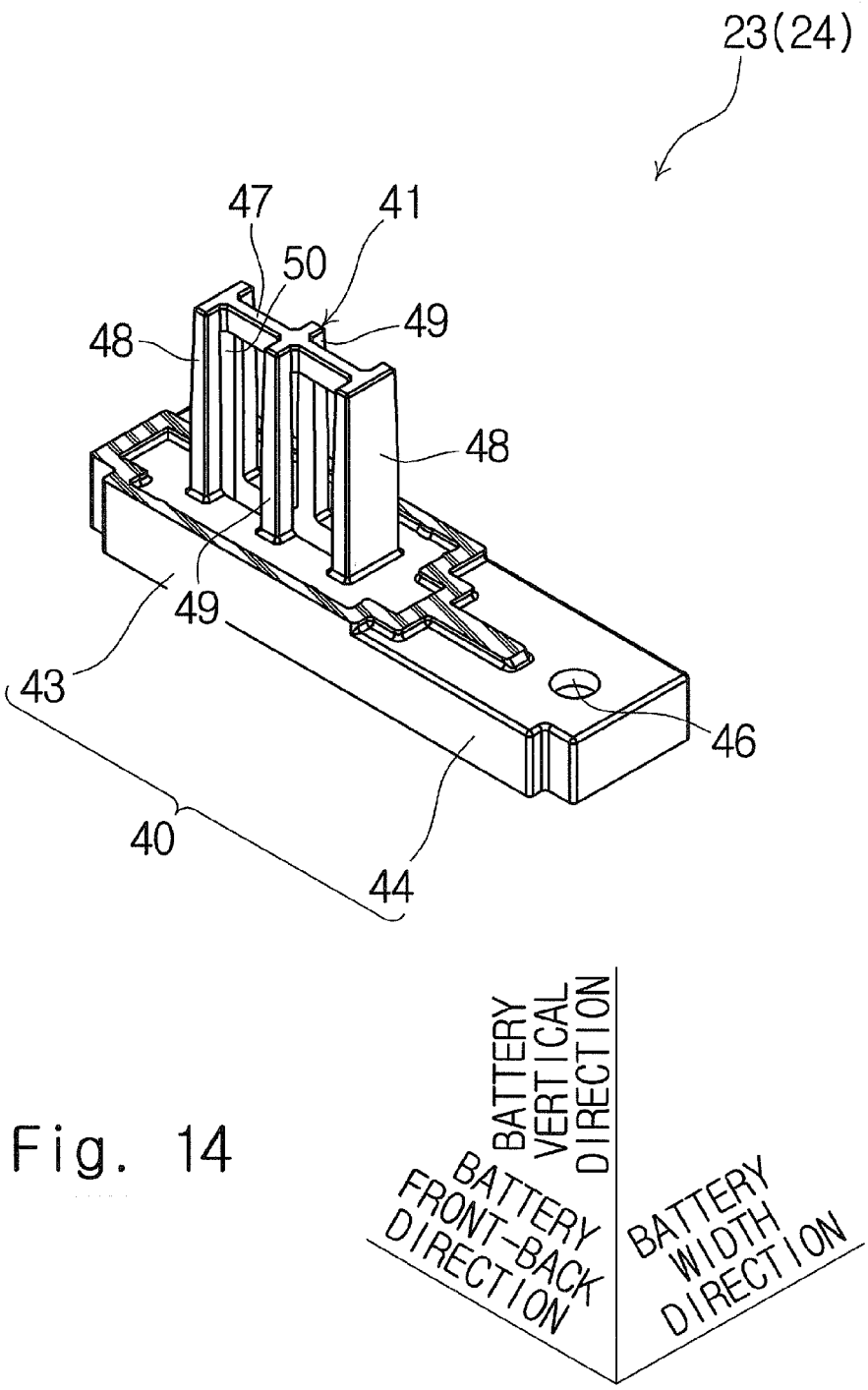
FIG. 14 is a partially cutaway perspective view of the upper housing divided body (first exemplary embodiment)

In the first exemplary embodiment, the upper housing divided body 23 and the lower housing divided body 24 have the same shape. As shown in FIG. 4, the lower housing divided body 24 is located in a position where the upper housing divided body 23 is rotated by 180 degrees about the axis of rotation parallel to the battery width direction. Accordingly, only the upper housing divided body 23 will be described below, and the description of the lower housing divided body 24 will be omitted. FIGS. 13 to 15 each show a perspective view of the upper housing divided body 23.

As shown in FIGS. 13 to 15, the upper housing divided body 23 includes a base 40 having a flat plate shape, an inner cover portion 41 (first inner cover portion), and an outer cover portion 42 (first outer cover portion).

The base 40 has a flat plate shape, and the thickness direction of the base 40 is substantially parallel to the battery vertical direction. The base 40 is formed in a rectangular shape elongated in the battery front-back direction. The base 40 includes a cover support portion 43 which is located on the battery backward direction side, and a connecting portion covering portion 44 (first connecting portion covering portion) which is located on the battery forward direction side. As shown in FIG. 15, the cover support portion 43 has an insertion hole 45 into which the upper contact portion 31 of the pin contact 20 shown in FIG. 11 can be inserted in the upward direction. As shown in FIGS. 13 and 14, the connecting portion covering portion 44 has a screw hole 46 formed therein for coupling the upper housing divided body 23 and the lower housing divided body 24 with the screw 22.

As shown in FIG. 14, the inner cover portion 41 is formed so as to project upward from the cover support portion 43. The inner cover portion 41 includes a distal end face covering portion 47, a pair of side end face covering portions 48, and a pair of reinforcement beam portions 49. The distal end face covering portion 47 is a beam that covers the distal end face 31A of the upper contact portion 31 of the pin contact 20 shown in FIG. 11. The distal end face covering portion 47 extends along the distal end face 31A shown in FIG. 11. In other words, the distal end face covering portion 47 extends in the battery front-back direction. Each one of the pair of side end face covering portions 48 is a beam that covers a corresponding one of the pair of side end faces 31B of the upper contact portion 31 of the pin contact 20 shown in FIG. 11. Each one of the pair of side end face covering portions 48 extends along a corresponding one of the pair of side end faces 31B shown in FIG. 11. In other words, the pair of side end face covering portions 48 extends in the battery vertical direction. Specifically, the pair of side end face covering portions 48 projects upward from the cover support portion 43 of the base 40, and extends to both ends of the distal end face covering portion 47. Each one of the pair of reinforcement beam portions 49 is a beam for reinforcing the distal end face covering portion 47. Each one of the pair of reinforcement beam portions 49 extends along a corresponding one of the pair of contact surfaces 31C shown in FIG. 11. In other words, the pair of reinforcement beam portions 49 extends in the battery vertical direction. Specifically, the pair of reinforcement beam portions 49 projects upward from the cover support portion 43 of the base 40, and extends to the center in the longitudinal direction of the distal end face covering portion 47. In the above structure, a contact portion insertion space 50 in which the upper contact portion 31 of the pin contact 20 shown in FIG. 11 is inserted is formed at the inside of the inner cover portion 41.

As shown in FIGS. 13 and 15, the outer cover portion 42 is disposed outside the inner cover portion 41 and forms a connector insertion space 51 in which the upper socket connector 10 shown in FIG. 1 is inserted. As shown in FIGS. 13 and 15, the outer cover portion 42 is formed to have a square tube shape extending in the battery vertical direction. As shown in FIGS. 13 to 15, the outer cover portion 42 is formed so as to project upward from the cover support portion 43. As shown in FIG. 13, the outer cover portion 42 is formed in a flat shape. Specifically, the dimension of the outer cover portion 42 in the battery width direction is smaller than the dimension of the outer cover portion 42 in the battery front-back direction. The outer cover portion 42 includes a pair of large side walls 52 and a pair of small side walls 53 (side walls). The large side walls 52 are opposed to each other in the battery width direction, and the small side walls 53 are opposed to each other in the battery front-back direction. The pair of large side walls 52 defines the connector insertion space 51 in the battery width direction. The pair of small side walls 53 defines the connector insertion space 51 in the battery front-back direction. Each one of the pair of small side walls 53 is a side wall opposed to a corresponding one of the pair of side end faces 31B shown in FIG. 11. In other words, the small side wall 53 located on the battery backward direction side is a side wall located on the side opposite to the side end face 31B located on the battery forward direction side across the side end face 31B located on the battery backward direction side. The small side wall 53 located on the battery forward direction side is a side wall located on the side opposite to the side end face 31B located on the battery backward direction side across the side end face 31B located on the battery forward direction side. Each one of a pair of pin-side lock portions 54 is formed on a corresponding one of the pair of small side walls 53. Each one of the pair of pin-side lock portions 54 is a portion that prevents the upper socket connector 10 mated with the pin connector 6 from being disengaged from the pin connector 6. Each one of the pair of pin-side lock portions 54 is formed on a corresponding one of the pair of small side walls 53, instead of being formed on a corresponding one of the pair of large side walls 52, thereby suppressing a dimension W in the battery width direction of the outer cover portion 42 as shown in FIG. 16.

As shown in FIG. 13, the upper housing divided body 23 further includes a reinforcement rib 55. The reinforcement rib 55 is formed between the outer cover portion 42 and the connecting portion covering portion 44.

(Assembly of the Pin Connector 6)

A method for assembling the pin connector 6 will be described below. As shown in FIGS. 9 and 10, the upper contact portion 31 of the pin contact 20 is inserted into the insertion hole 45 of the upper housing divided body 23 and the lower contact portion 32 of the pin contact 20 is inserted into the insertion hole 45 of the lower housing divided body 24, so that the upper housing divided body 23 and the lower housing divided body 24 can be coupled together with the pair of screws 22. After the coupling, as shown in FIGS. 5 and 6, the upper contact portion 31 of the pin contact 20 is partially exposed from the inner cover portion 41 of the upper housing divided body 23. Similarly, the lower contact portion 32 of the pin contact 20 is partially exposed from the inner cover portion 41 of the lower housing divided body 24.

(Upper Socket Connector 10)

Figure 17:
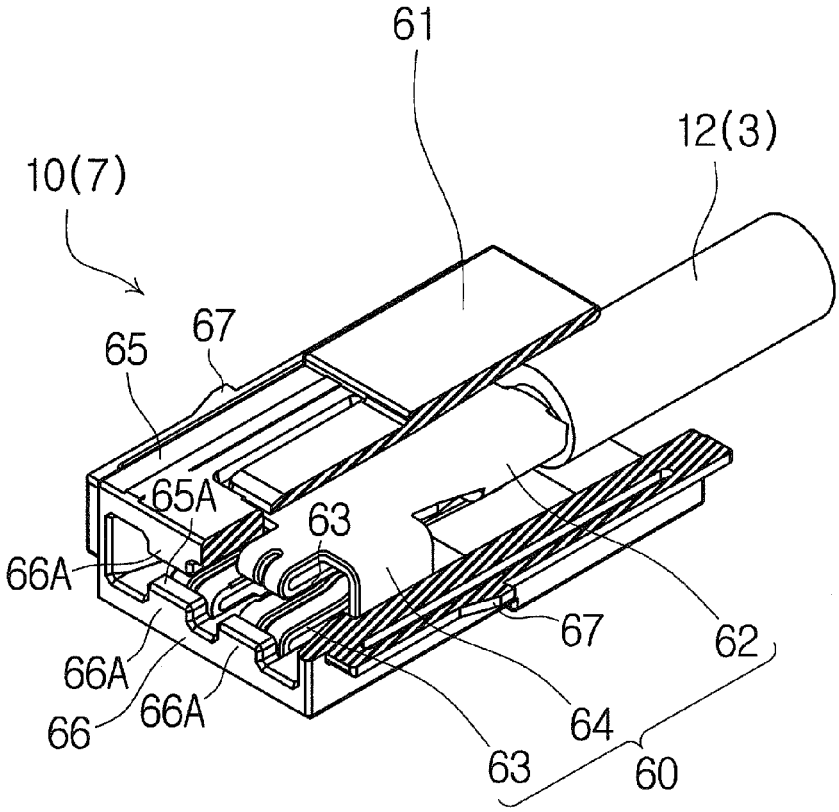
FIG. 17 is a partially cutaway perspective view of a socket connector attached to an end of a cable (first exemplary embodiment)
Figure 17:
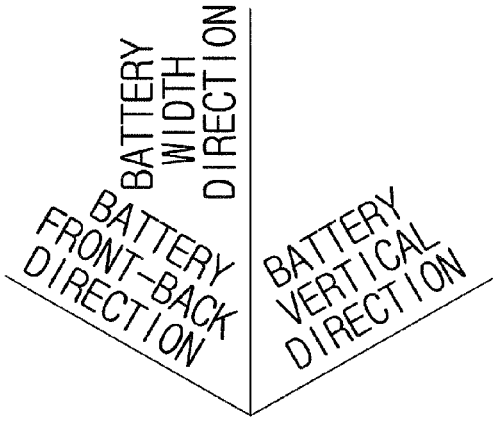
Figure 18:
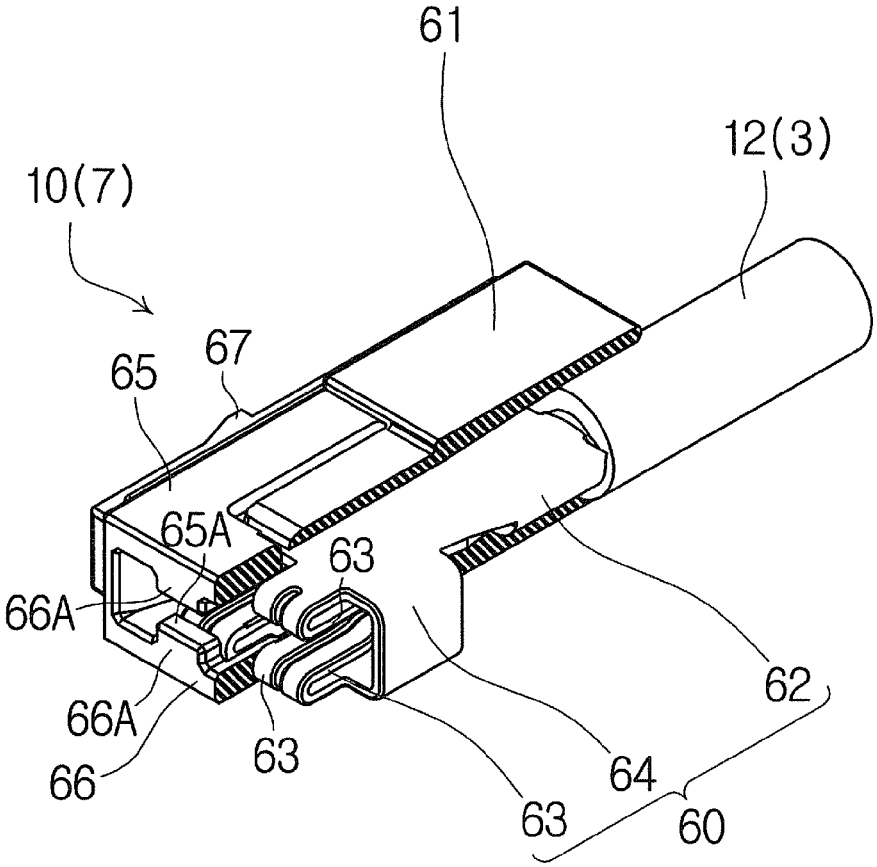
FIG. 18 is a partially cutaway perspective view of the socket connector attached to an end of the cable (first exemplary embodiment)
Figure 18:
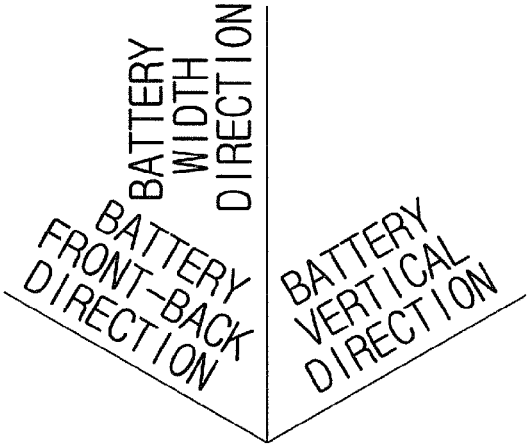

In the first exemplary embodiment, the upper socket connector 10 and the lower socket connector 11 have the same shape. Accordingly, only the upper socket connector 10 will be described, and the description of the lower socket connector 11 will be omitted. FIGS. 17 and 18 each show a partially cutaway perspective view of the upper socket connector 10.

As shown in FIGS. 17 and 18, the upper socket connector 10 includes a socket contact 60 and a socket housing 61 that accommodates the socket contact 60.

The socket contact 60 includes a crimp 62, eight contact spring pieces 63, and a square-tube-shaped holding portion 64. The crimp 62 is crimped to the conductor of the upper cable 12. The holding portion 64 holds the eight contact spring pieces 63. Four of the contact spring pieces 63 are disposed separately from the other four of the contact spring pieces 63 in the battery width direction.

The socket housing 61 includes a housing body 65, an opening limiting portion 66, and a pair of socket-side lock portions 67. The housing body 65 extends in a square tube shape in the battery vertical direction. The opening limiting portion 66 partially blocks an opening 65A on a lower side of the housing body 65. The opening limiting portion 66 partially blocks the opening 65A of the housing body 65, thereby minimizing the opening area of the opening 65A of the housing body 65. The term "minimizing" herein used means that the opening area is limited to a minimum area required to insert the upper contact portion 31 of the pin contact 20 shown in FIG. 6 and the inner cover portion 41 of the upper housing divided body 23 into the opening 65A of the housing body 65. Accordingly, the opening limiting portion 66 includes spring piece opposed portions 66A that are opposed to the eight contact spring pieces 63 of the socket contact 60 in the battery vertical direction. Each one of the pair of socket-side lock portions 67 is formed to have a claw shape and is supported by the housing body 65 so as to be elastically displaceable in the battery front-back direction.

(How to Use the Connector Assembly 1)

Next, an example of how to use the connector assembly 1 will be described with reference to FIGS. 1 to 3.

First, the pin connectors 6 are respectively attached to the pair of electrodes 5 of each battery 2. Next, a plurality of batteries 2 are disposed at a predetermined pitch in the battery vertical direction by using a battery storage rack or the like. Then, the socket connectors 7 are respectively attached to both ends of each cable 3 that is cut at a predetermined length. Lastly, as shown in FIG. 3, the pair of socket connectors 7 attached to both ends of the cable 3 is mated with the respective pin connectors 6 of a pair of batteries 2 adjacent to each other in the battery vertical direction, while the cable 3 is slightly warped in the battery front-back direction. Specifically, the lower socket connector 11 attached to an upper end of the cable 3 is inserted upward into the connector insertion space 51 (see FIG. 13)

of the lower housing divided body 24 of the pin connector 6 located on an upper side of the cable 3, and the pair of socket-side lock portions 67 (see FIG. 17) of the lower socket connector 11 is hooked to the pair of pin-side lock portions 54 (see FIG. 13) of the lower housing divided body 24 of the pin connector 6, thereby mating the lower socket connector 11 with the pin connector 6. Similarly, the upper socket connector 10 attached to a lower end of the cable 3 is inserted downward into the connector insertion space 51 (see FIG. 13) of the upper housing divided body 23 of the pin connector 6 located on a lower side of the cable 3, and the pair of socket-side lock portions 67 (see FIG. 17) of the upper socket connector 10 is hooked to the pair of pin-side lock portions 54 (see FIG. 13) of the upper housing divided body 23 of the pin connector 6, thereby mating the upper socket connector 10 with the pin connector 6. As a result, the electrodes 5 of the pair of batteries 2 adjacent to each other in the battery vertical direction are electrically connected to each other. More specifically, eight contact spring pieces 63 of the socket contact 60 of the lower socket connector 11 attached to an upper end of the cable 3 are each brought into contact with the pair of contact surfaces 32C of the lower contact portion 32 of the pin contact 20 of the pin connector 6. Similarly, eight contact spring pieces 63 of the socket contact 60 of the upper socket connector 10 attached to a lower end of the cable 3 are each brought into contact with the pair of contact surfaces 31C of the upper contact portion 31 of the pin contact 20 of the pin connector 6.

The connector assembly 1 of the first exemplary embodiment described above has the following features.

(1) As shown in FIGS. 1 to 12, each pin connector 6 (electric connector) is attached to the corresponding battery 2 (connection object), is mated with the upper socket connector 10 (first connector) attached to the upper cable 12 (first electric wire) to thereby electrically connect the upper cable 12 to the battery 2, and is mated with the lower socket connector 11 (second connector) attached to the lower cable 13 (second electric wire) to thereby electrically connect the lower cable 13 to the battery 2. The pin connector 6 includes the pin contact 20 (contact) and the pin housing 21 (housing) attached to the pin contact 20. The pin housing 21 includes: the pair of pin-side lock portions 54 (first retaining portion) that prevents the upper socket connector 10 mated with the pin connector 6 from being disengaged from the pin connector 6; and the pair of pin-side lock portions 54 (second retaining portion) that prevents the lower socket connector 11 mated with the pin connector 6 from being disengaged from the pin connector 6. The pin contact 20 includes: the upper contact portion 31 (first contact portion) that has a flat plate shape and is capable of being in electrical contact with the upper socket connector 10; the lower contact portion 32 that has a flat plate shape and is capable of being in electrical contact with the lower socket connector 11; and the electrode contact portion 30 (third contact portion) that has a flat plate shape and is capable of being in electrical contact with the battery 2. The thickness direction of the upper contact portion 31 and the thickness direction of the lower contact portion 32 are substantially perpendicular to the thickness direction of the electrode contact portion 30. The direction in which the upper socket connector 10 is mated with the pin connector 6 is different from the direction in which the lower socket connector 11 is mated with the pin connector 6. The above structure contributes to downsizing of the pin connector 6 in the battery width direction when viewed along the thickness direction of the electrode contact portion 30, as compared with the case where the thickness direction of the upper contact portion 31 and the thickness direction of the lower contact portion 32 are parallel or oblique to the thickness direction of the electrode contact portion 30.

(2) As shown in FIG. 1, the direction in which the upper socket connector 10 is mated with the pin connector 6 is opposite to the direction in which the lower socket connector 11 is mated with the pin connector 6. According to the above structure, when a plurality of batteries 2 are arranged along the direction in which the upper socket connectors 10 are respectively mated with the pin connectors 6 as shown in FIG. 3, each pin connector 6 is suitable for use in connecting a pair of adjacent batteries 2.

(3) As shown in FIG. 1, the direction in which the upper socket connector 10 is mated with the pin connector 6 and the direction in which the lower socket connector 11 is mated with the pin connector 6 are substantially parallel to the thickness direction of the electrode contact portion 30. According to the above structure, when a plurality of batteries 2 are arranged along the thickness direction of the electrode contact portion 30, each pin connector 6 is suitable for use in connecting a pair of adjacent batteries 2.

(4) As shown in FIGS. 11 and 12, the central axis C1 of the upper contact portion 31 does not coincide with the virtual extension Q of the central axis C2 of the lower contact portion 32. The central axis C1 is parallel to the direction in which the upper socket connector 10 is mated with the pin connector 6. The central axis C2 is parallel to the direction in which the lower socket connector 11 is mated with the pin connector 6. According to the above structure, when a plurality of batteries 2 are arranged along the direction in which the upper socket connector 10 is mated with the pin connector 6, the central axis C1 of the upper contact portion 31 of the pin connector 6 attached to one of a pair of adjacent batteries 2 does not coincide with the virtual extension Q of the central axis C2 of the lower contact portion 32 of the pin connector 6 attached to the other one of the pair of adjacent batteries 2. Accordingly, when a pair of adjacent batteries 2 is connected with the cable 3, the cable 3 is inevitably warped. This results in the time and labor needed for strictly managing the length of each cable 3 being saved, unlike in the case where the central axis C1 of the upper contact portion 31 coincides with the central axis C2 of the lower contact portion 32.

(5) As shown in FIGS. 13 and 15, the pin housing 21 includes a cover portion 70 (first cover portion) of the upper housing divided body 23 that covers the upper contact portion 31, and a cover portion 70 (second cover portion) of the lower housing divided body 24 that covers the lower contact portion 32. According to the above structure, the upper contact portion 31 is covered with the cover portion 70 of the upper housing divided body 23 and the lower contact portion 32 is covered with the cover portion 70 of the lower housing divided body 24. Consequently, the above structure prevents direct touching of the upper contact portion 31 and the lower contact portion 32 by fingers, and contributes to prevention of electric shock.

The cover portion 70 includes the inner cover portion 41 and the outer cover portion 42.

(6) The cover portion 70 of the upper housing divided body 23 (first housing divided body) includes: the inner cover portion 41 (first inner cover portion) formed of the distal end face covering portion 47 and the side end face covering portions 48 (a plurality of beams) respectively extending along the distal end face 31A and both of the side end faces 31B of the upper contact portion 31; and the outer cover portion 42 (first outer cover portion) that is disposed outside the inner cover portion 41 and forms the connector insertion space 51 (space) into which the upper socket connector 10 is inserted. The cover portion 70 of the lower housing divided body 24 (second housing divided body) includes: the inner cover portion 41 (second inner cover portion) formed of the distal end face covering portion 47 and the side end face covering portions 48 (a plurality of beams) respectively extending along the distal end face 32A and both of the side end faces 32B of the lower contact portion 32; and the outer cover portion 42 (second outer cover portion) that is disposed outside the inner cover portion 41 and forms the connector insertion space 51 (space) into which the lower socket connector 11 is inserted. The above structure more effectively prevents the upper contact portion 31 and the lower contact portion 32 from being directly touched by fingers, and greatly contributes to prevention of electric shock.

(7) The pin housing 21 is formed of at least two components including the upper housing divided body 23 and the lower housing divided body 24. That is, the pin housing 21 includes the upper housing divided body 23 and the lower housing divided body 24. The upper housing divided body 23 includes the cover portion 70 that covers the upper contact portion 31. The lower housing divided body 24 includes the cover portion 70 that covers the lower contact portion 32. According to the above structure, even when the pin housing 21 is formed of at least two components, the cover portion 70 that covers the upper contact portion 31 is not divided and the cover portion 70 that covers the lower contact portion 32 is not divided. Accordingly, even when the pin housing 21 is formed of at least two components, the strength of the cover portion 70 that covers the upper contact portion 31 and the strength of the cover portion 70 that covers the lower contact portion 32 can be easily secured.

(8) As shown in FIGS. 11 and 13, the upper housing divided body 23 includes the connecting portion covering portion 44 (first connecting portion covering portion) that covers the lower connecting portion 35 (second connecting portion) serving as a connecting portion between the lower contact portion 32 and the electrode contact portion 30. Similarly, the lower housing divided body 24 includes a connecting portion covering portion 44 (second connecting portion covering portion) that covers the upper connecting portion 34 (first connecting portion) serving as a connecting portion between the upper contact portion 31 and the electrode contact portion 30. According to the above structure, the upper connecting portion 34 and the lower connecting portion 35 can be covered without increasing the number of components.

(9) As shown in FIG. 13, in the upper housing divided body 23, the pair of pin-side lock portions 54 is formed on the small side walls 53 (side walls) of the outer cover portion 42 of the cover portion 70. The small side walls 53 are respectively opposed to the side end faces 31B of the upper contact portion 31. Similarly, in the lower housing divided body 24, the pair of pin-side lock portions 54 is formed on the small side walls 53 (side walls) of the outer cover portion 42 of the cover portion 70. The small side walls 53 are respectively opposed to the side end faces 32B of the lower contact portion 32. The above structure contributes to downsizing of the pin connector 6 when viewed along the thickness direction of the electrode contact portion 30 as shown in FIG. 16, as compared with the case where in the upper housing divided body 23, the pair of pin-side lock portions 54 is formed on the large side walls 52, which are opposed to the upper contact portion 31 in the thickness direction of the upper contact portion 31, of the outer cover portion 42 of the cover portion 70, and in the lower housing divided body 24, the pair of pin-side lock portions 54 is formed on the large side walls 52, which are opposed to the lower contact portion 32 in the thickness direction of the lower contact portion 32, of the outer cover portion 42 of the cover portion 70.

(10) As shown in FIG. 2, a connection object unit 71 includes the battery 2 and the connector assembly 1.

(11) As shown in FIG. 3, a connection object unit assembly 72 has a structure in which a plurality of connection object units 71 are disposed in the thickness direction of the electrode contact portion 30.

As shown in FIG. 11, the thickness direction of the upper contact portion 31 and the thickness direction of the lower contact portion 32 are substantially parallel to each other. The above structure contributes to downsizing of the pin connector 6 in the battery width direction, as compared with the case where the upper contact portion 31 and the lower contact portion 32 are not parallel.

As shown in FIGS. 11 and 12, one of the pair of contact surfaces 31C of the upper contact portion 31 which is farther from the electrode contact portion 30 than the other one is substantially flush with one of the pair of contact surfaces 32C of the lower contact portion 32 which is farther from the electrode contact portion 30 than the other one. The above structure contributes to downsizing of the pin connector 6 in the battery width direction, as compared with the case where one of the pair of contact surfaces 31C of the upper contact portion 31 which is farther from the electrode contact portion 30 than the other one is not flush with one of the pair of contact surfaces 32C of the lower contact portion 32 which is farther from the electrode contact portion 30 than the other one.

As shown in FIG. 1, in the first exemplary embodiment, the direction in which the upper socket connector 10 is mated with the pin connector 6 is the downward direction. The direction in which the lower socket connector 11 is mated with the pin connector 6 is the upward direction.

As shown in FIGS. 1 to 4, in the state where the pin connector 6 is attached to the battery 2, the lower housing divided body 24 of the pin housing 21 of the pin connector 6 is opposed to the corresponding side surface 4E of the battery body 4 in the battery width direction.

The first exemplary embodiment described above can be modified as follows.

In the first exemplary embodiment described above, the pin contact 20 is formed by bending a single metallic plate M as shown in FIGS. 11 and 12. Alternatively, the electrode contact portion 30, the upper contact portion 31, and the lower contact portion 32 may be prepared as separate components, and the upper contact portion 31 and the lower contact portion 32 may be welded to the electrode contact portion 30.

Second Exemplary Embodiment

Figure 19:
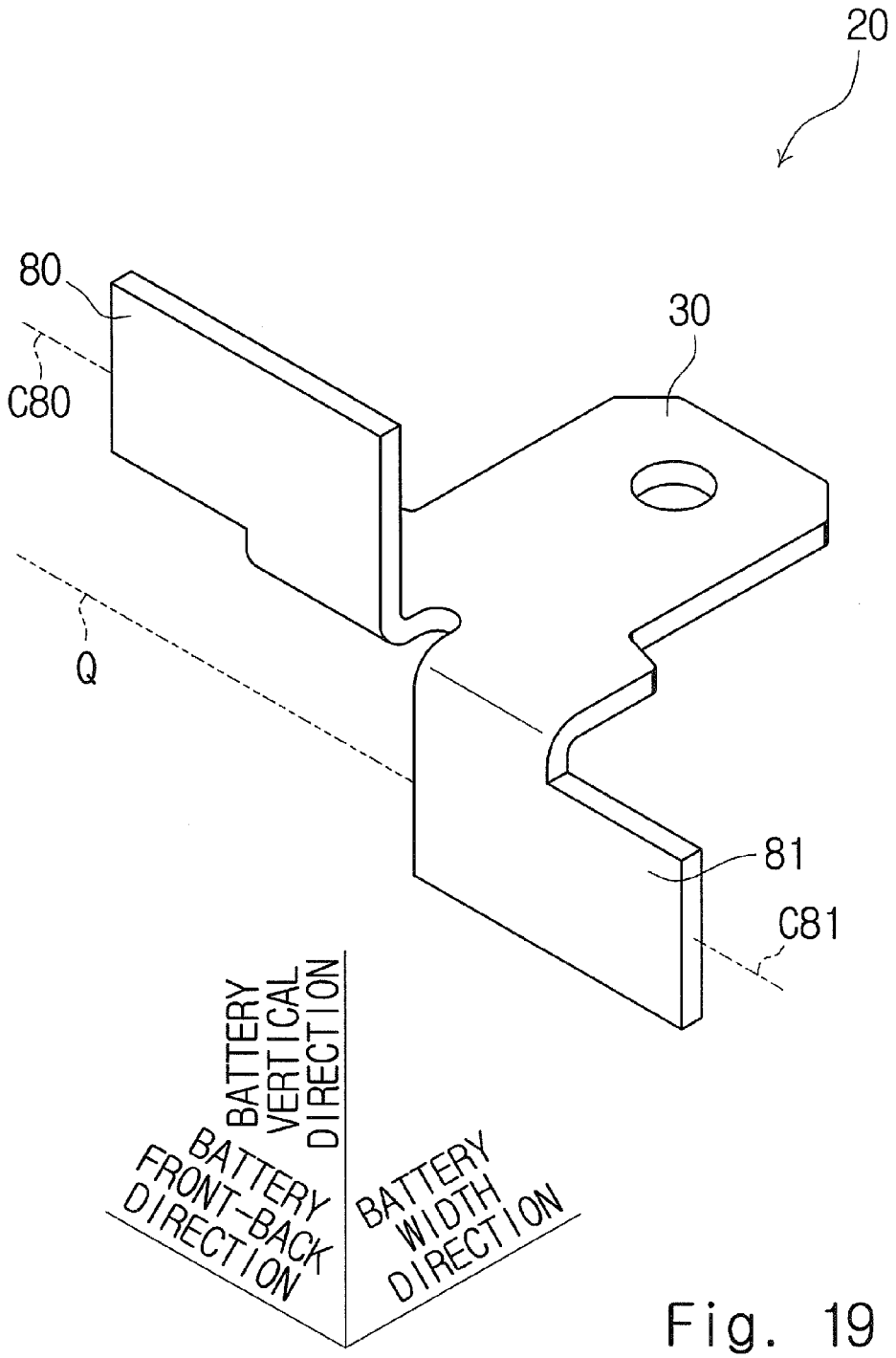
FIG. 19 is a perspective view of a pin contact (second exemplary embodiment)

Next, a second exemplary embodiment will be described with reference to FIG. 19. FIG. 19 shows a perspective view of the pin contact 20. Differences between the second exemplary embodiment and the first exemplary embodiment will be mainly described, while a repeat of previous descriptions is omitted.

As shown in FIG. 19, in the second exemplary embodiment, the pin contact 20 includes the electrode contact portion 30 (third contact portion), a back contact portion 80 (first contact portion), and a front contact portion 81 (second contact portion).

The thickness direction of the back contact portion 80 and the thickness direction of the front contact portion 81 are substantially perpendicular to the thickness direction of the electrode contact portion 30. This contributes to downsizing of the pin connector 6 in the battery width direction.

The back contact portion 80 projects in the battery backward direction from the electrode contact portion 30. The front contact portion 81 projects in the battery forward direction from the electrode contact portion 30. Accordingly, the direction in which a connector connected to the back contact portion 80 is mated with the pin connector 6 is opposite to the direction in which a connector connected to the front contact portion 81 is mated with the pin connector 6. Specifically, the direction in which the connector connected to the back contact portion 80 is mated with the pin connector 6 is the battery forward direction, and the direction in which the connector connected to the front contact portion 81 is mated with the pin connector 6 is the battery backward direction.

A central axis C80 of the back contact portion 80 does not coincide with the virtual extension Q of a central axis C81 of the front contact portion 81. In other words, the back contact portion 80 and the front contact portion 81 are disposed at different locations in the battery vertical direction. The back contact portion 80 is formed so as to be bent upward from the electrode contact portion 30. The front contact portion 81 is formed so as to be bent downward from the electrode contact portion 30. This results in the time and labor needed for strictly managing the length of each cable 3 being saved.

Third Exemplary Embodiment

Figure 20:
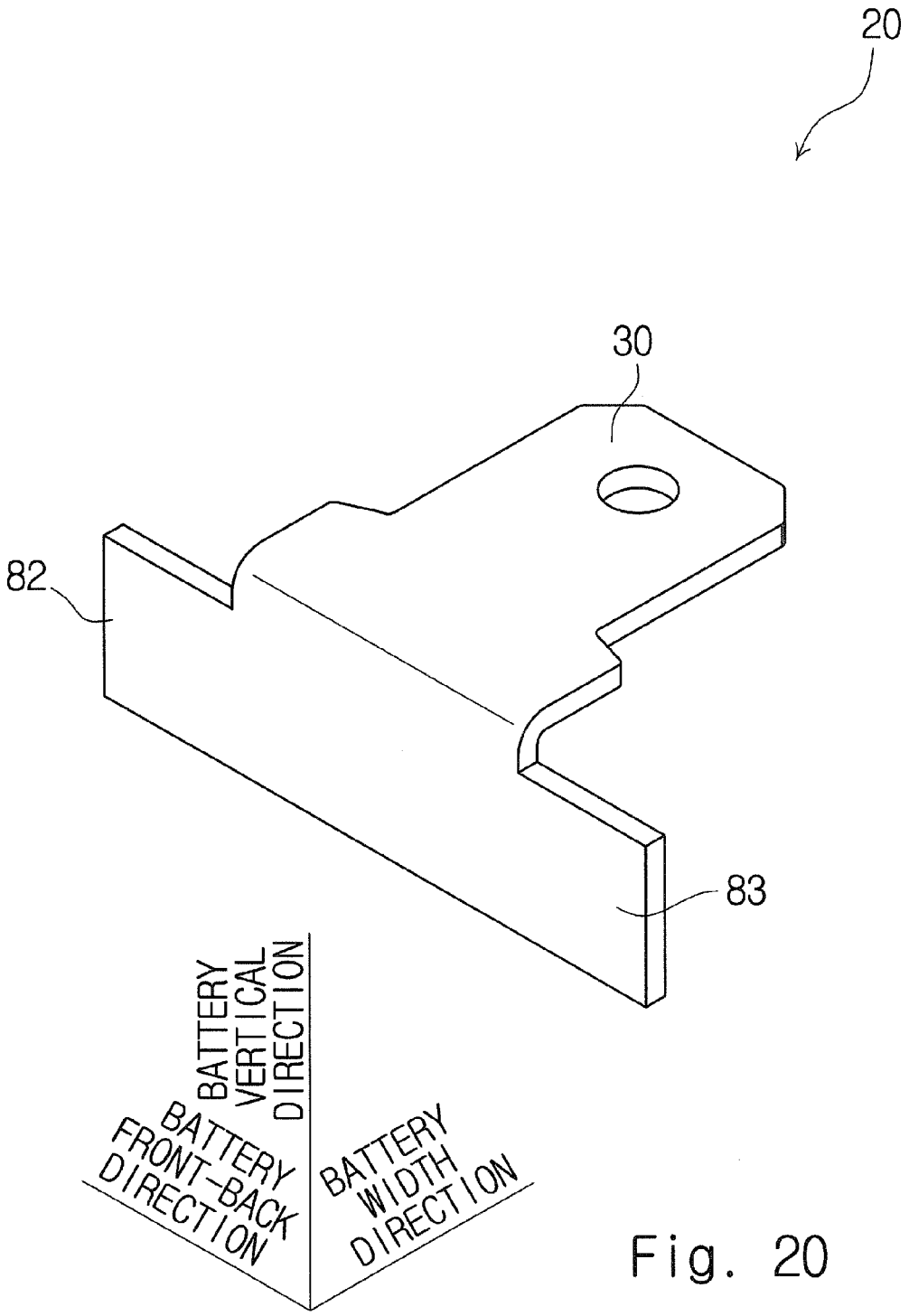
FIG. 20 is a perspective view of a pin contact (third exemplary embodiment)

Next, a third exemplary embodiment will be described with reference to FIG. 20. FIG. 20 shows a perspective view of the pin contact 20. Differences between the third exemplary embodiment and the first exemplary embodiment will be mainly described, while a repeat of previous descriptions is omitted.

As shown in FIG. 20, in the third exemplary embodiment, the pin contact 20 includes the electrode contact portion 30 (third contact portion), a back contact portion 82 (first contact portion), and a front contact portion 83 (second contact portion).

The thickness direction of the back contact portion 82 and the thickness direction of the front contact portion 83 are substantially perpendicular to the thickness direction of the electrode contact portion 30. This contributes to downsizing of the pin connector 6 in the battery width direction.

The back contact portion 82 projects in the battery backward direction from the electrode contact portion 30. The front contact portion 83 projects in the battery forward direction from the electrode contact portion 30. Accordingly, the direction in which a connector connected to the back contact portion 82 is mated with the pin connector 6 is opposite to the direction in which a connector connected to the front contact portion 83 is mated with the pin connector 6. Specifically, the direction in which the connector connected to the back contact portion 82 is mated with the pin connector 6 is the battery forward direction, and the direction in which the connector connected to the front contact portion 83 is mated with the pin connector 6 is the battery backward direction.

Fourth Exemplary Embodiment

Figure 21:
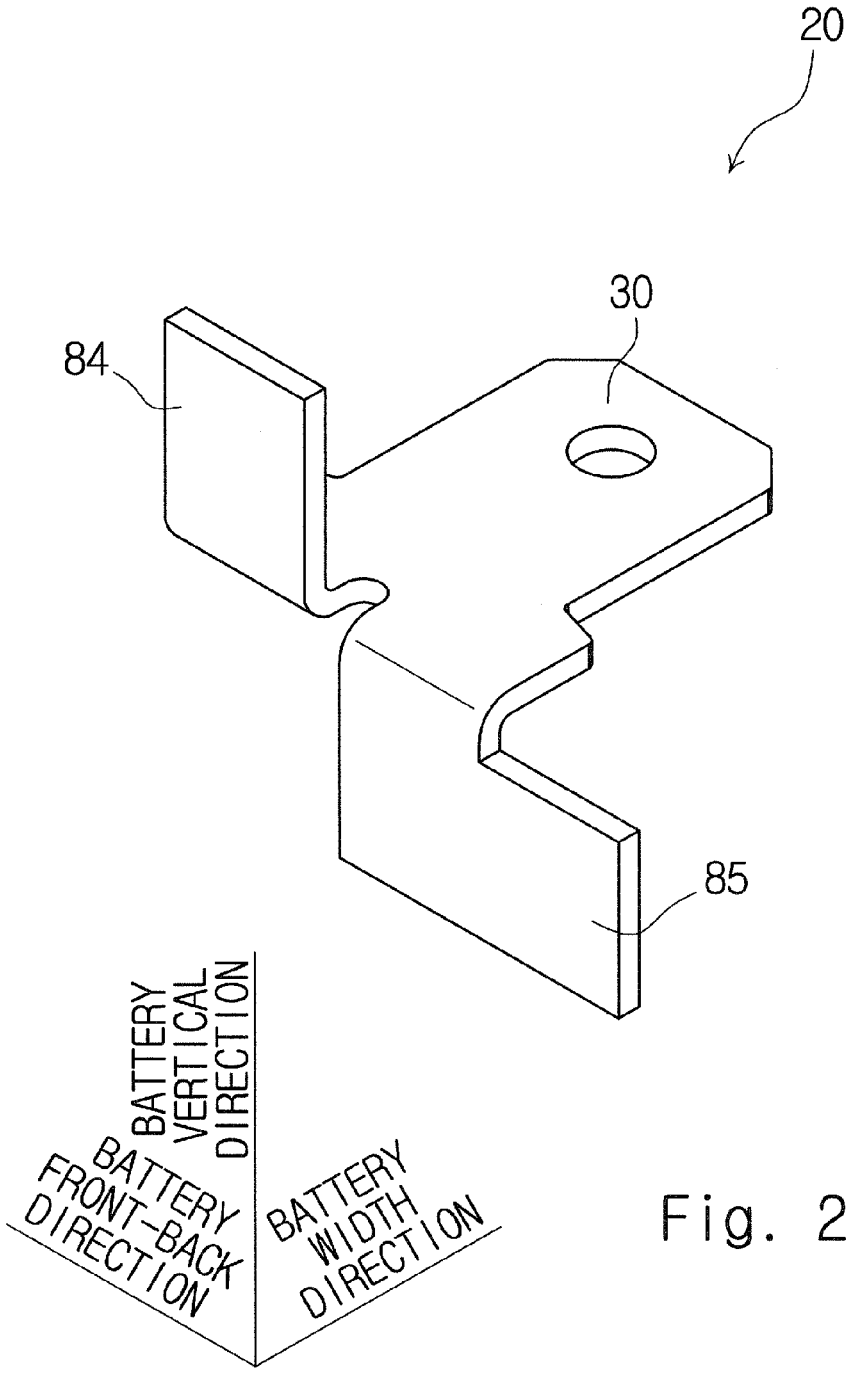
FIG. 21 is a perspective view of a pin contact (fourth exemplary embodiment)
Figure 22:
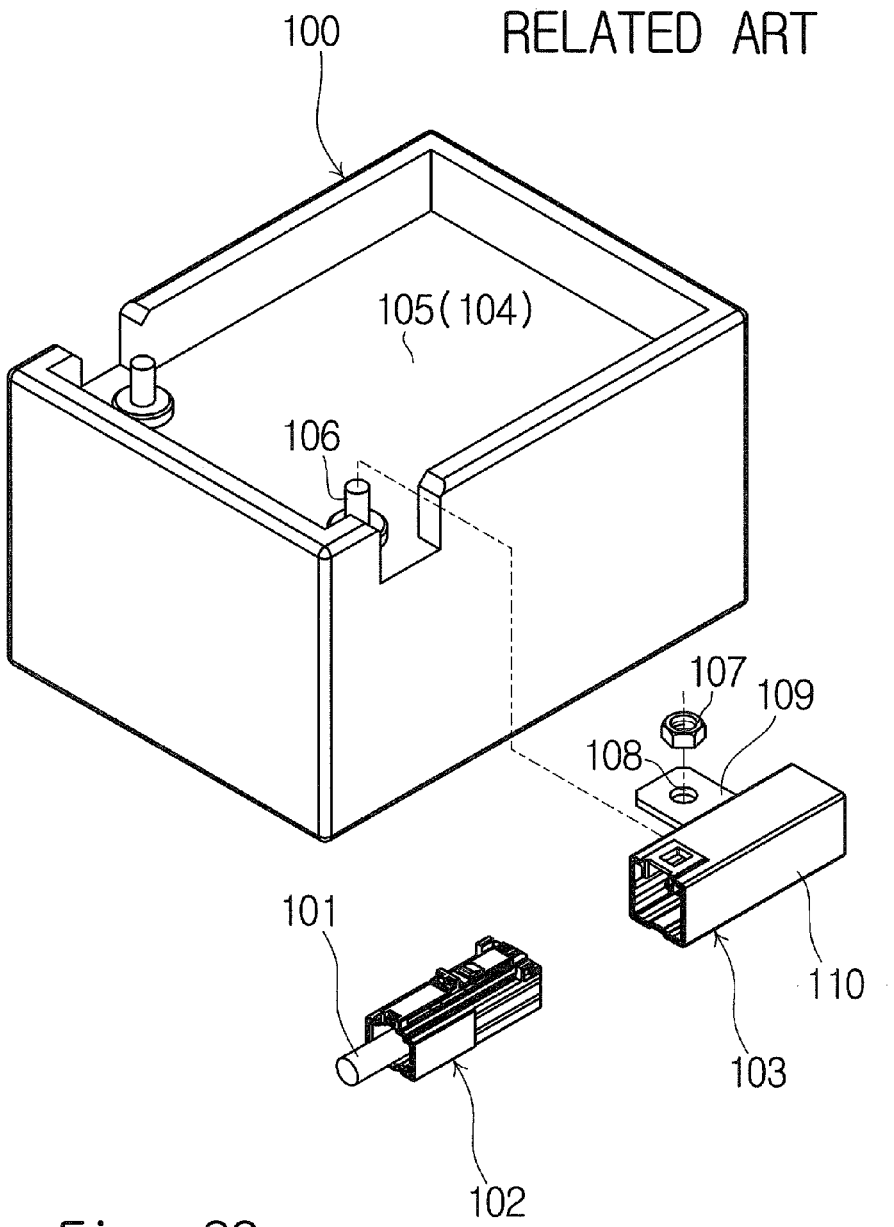
FIG. 22 is a view corresponding to FIG. 5 of Japanese Patent No. 5352723.

Next, a fourth exemplary embodiment will be described with reference to FIG. 21. FIG. 21 shows a perspective view of the pin contact 20. Differences between the fourth exemplary embodiment and the first exemplary embodiment will be mainly described, while a repeat of previous descriptions is omitted.

As shown in FIG. 21, in the fourth exemplary embodiment, the pin contact 20 includes the electrode contact portion 30 (third contact portion), an upper contact portion 84 (first contact portion), and a front contact portion 85 (second contact portion).

The thickness direction of the upper contact portion 84 and the thickness direction of the front contact portion 85 are substantially perpendicular to the thickness direction of the electrode contact portion 30. This contributes to downsizing of the pin connector 6 in the battery width direction.

The upper contact portion 84 projects upward from the electrode contact portion 30. The front contact portion 85 projects in the battery forward direction from the electrode contact portion 30. Accordingly, the direction in which a connector connected to the upper contact portion 84 is mated with the pin connector 6 is different from the direction in which a connector connected to the front contact portion 85 is mated with the pin connector 6. Specifically, the direction in which the connector connected to the upper contact portion 84 is mated with the pin connector 6 is the downward direction, and the direction in which the connector connected to the front contact portion 85 is mated with the pin connector 6 is the battery backward direction.

Accordingly, in the case of arranging a plurality of batteries 2 in the battery vertical direction as shown in FIG. 3, work for mating the lower socket connector 11 with the pin connector 6 is facilitated by attaching the pin connector 6 of the fourth exemplary embodiment to the lowermost battery 2.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electric connector that is attached to a connection object, is mated with a first connector attached to a first electric wire to thereby electrically connect the first electric wire to the connection object, and is mated with a second connector attached to a second electric wire to thereby electrically connect the second electric wire to the connection object, the electric connector comprising:

a contact; and a housing that is attached to the contact, the housing including: a first retaining portion that prevents the first connector mated with the electric connector from being disengaged from the electric connector; and a second retaining portion that prevents the second connector mated with the electric connector from being disengaged from the electric connector, wherein the contact includes:

a first contact portion having a flat plate shape and capable of being in electrical contact with the first connector;

a second contact portion having a flat plate shape and capable of being in electrical contact with the second connector; and a third contact portion having a flat plate shape and capable of being in electrical contact with the connection object, a thickness direction of the first contact portion and a thickness direction of the second contact portion are substantially perpendicular to a thickness direction of the third contact portion, a direction in which the first connector is mated with the electric connector is different from a direction in which the second connector is mated with the electric connector, the housing includes a first cover portion that covers the first contact portion and a second cover portion that covers the second contact portion, the first cover portion includes:

a first inner cover portion formed of a plurality of beams respectively extending along a distal end face and both side end faces of the first contact portion; and a first outer cover portion that is disposed outside the first inner cover portion and forms a space into which the first connector is capable of being inserted, and the second cover portion includes:

a second inner cover portion formed of a plurality of beams respectively extending along a distal end face and both side end faces of the second contact portion; and a second outer cover portion that is disposed outside the second inner cover portion and forms a space into which the second connector is capable of being inserted.

2. The electric connector according to claim 1, wherein the direction in which the first connector is mated with the electric connector is opposite to the direction in which the second connector is mated with the electric connector.

3. The electric connector according to claim 2, wherein the direction in which the first connector is mated with the electric connector and the direction in which the second connector is mated with the electric connector are substantially parallel to the thickness direction of the third contact portion.

4. The electric connector according to claim 2, wherein a central axis of the first contact portion does not coincide with a virtual extension of a central axis of the second contact portion, the central axis of the first contact portion being parallel to the direction in which the first connector is mated with the electric connector, and the central axis of the second contact portion being parallel to the direction in which the second connector is mated with the electric connector.

5. An electric connector that is attached to a connection object, is mated with a first connector attached to a first electric wire to thereby electrically connect the first electric wire to the connection object, and is mated with a second connector attached to a second electric wire to thereby electrically connect the second electric wire to the connection object, the electric connector comprising:

a contact; and a housing that is attached to the contact, the housing including: a first retaining portion that prevents the first connector mated with the electric connector from being disengaged from the electric connector; and a second retaining portion that prevents the second connector mated with the electric connector from being disengaged from the electric connector, wherein the contact includes:

a first contact portion having a flat plate shape and capable of being in electrical contact with the first connector;

a second contact portion having a flat plate shape and capable of being in electrical contact with the second connector; and a third contact portion having a flat plate shape and capable of being in electrical contact with the connection object, a thickness direction of the first contact portion and a thickness direction of the second contact portion are substantially perpendicular to a thickness direction of the third contact portion, a direction in which the first connector is mated with the electric connector is different from a direction in which the second connector is mated with the electric connector, the housing includes a first cover portion that covers the first contact portion and a second cover portion that covers the second contact portion, the housing is formed of at least two components including a first housing divided body including the first cover portion, and a second housing divided body including the second cover portion, the first housing divided body includes a first connecting portion covering portion that covers a second connecting portion serving as a connecting portion between the second contact portion and the third contact portion, and the second housing divided body includes a second connecting portion covering portion that covers a first connecting portion serving as a connecting portion between the first contact portion and the third contact portion.

6. The electric connector according to claim 5, wherein the direction in which the first connector is mated with the electric connector is opposite to the direction in which the second connector is mated with the electric connector.

7. The electric connector according to claim 6, wherein the direction in which the first connector is mated with the electric connector and the direction in which the second connector is mated with the electric connector are substantially parallel to the thickness direction of the third contact portion.

8. The electric connector according to claim 6, wherein a central axis of the first contact portion does not coincide with a virtual extension of a central axis of the second contact portion, the central axis of the first contact portion being parallel to the direction in which the first connector is mated with the electric connector, and the central axis of the second contact portion being parallel to the direction in which the second connector is mated with the electric connector.

9. An electric connector that is attached to a connection object, is mated with a first connector attached to a first electric wire to thereby electrically connect the first electric wire to the connection object, and is mated with a second connector attached to a second electric wire to thereby electrically connect the second electric wire to the connection object, the electric connector comprising:

a contact; and a housing that is attached to the contact, the housing including: a first retaining portion that prevents the first connector mated with the electric connector from being disengaged from the electric connector; and a second retaining portion that prevents the second connector mated with the electric connector from being disengaged from the electric connector, wherein the contact includes:

a first contact portion having a flat plate shape and capable of being in electrical contact with the first connector;

a second contact portion having a flat plate shape and capable of being in electrical contact with the second connector; and a third contact portion having a flat plate shape and capable of being in electrical contact with the connection object, a thickness direction of the first contact portion and a thickness direction of the second contact portion are substantially perpendicular to a thickness direction of the third contact portion, a direction in which the first connector is mated with the electric connector is different from a direction in which the second connector is mated with the electric connector, the housing includes a first cover portion that covers the first contact portion and a second cover portion that covers the second contact portion, the first retaining portion is formed on side walls of the first cover portion, the side walls of the first cover portion being respectively opposed to side end faces of the first contact portion, and the second retaining portion is formed on side walls of the second cover portion, the side walls of the second cover portion being respectively opposed to side end faces of the second contact portion.

10. The electric connector according to claim 9, wherein the direction in which the first connector is mated with the electric connector is opposite to the direction in which the second connector is mated with the electric connector.

11. The electric connector according to claim 10, wherein the direction in which the first connector is mated with the electric connector and the direction in which the second connector is mated with the electric connector are substantially parallel to the thickness direction of the third contact portion.

12. The electric connector according to claim 10, wherein a central axis of the first contact portion does not coincide with a virtual extension of a central axis of the second contact portion, the central axis of the first contact portion being parallel to the direction in which the first connector is mated with the electric connector, and the central axis of the second contact portion being parallel to the direction in which the second connector is mated with the electric connector.

* * * * *